United States Patent [19]

Morita et al.

[11] Patent Number: 4,996,566

[45] Date of Patent: Feb. 26, 1991

[54] MULTICOLOR IMAGE FORMING APPARATUS WITH SEPARATELY REMOVABLE AND INSERTABLE ASSEMBLY UNITS

[75] Inventors: Shizuo Morita, Tachikawa; Shunji Matsuo, Hino; Satoshi Haneda, Tachikawa; Masakazu Fukuchi; Hisashi Shoji, both of Hachioji, all of Japan

[73] Assignee: Konica Corporation, Tokyo, Japan

[21] Appl. No.: 428,902

[22] Filed: Oct. 30, 1989

[30] Foreign Application Priority Data

Nov. 1, 1988 [JP] Japan ..... 63-278205
Dec. 16, 1988 [JP] Japan ..... 63-318934

[51] Int. Cl.[5] ..... G03G 21/00
[52] U.S. Cl. ..... 355/246; 355/326
[58] Field of Search ..... 355/326, 327, 328, 209, 355/206, 245, 246

[56] References Cited

U.S. PATENT DOCUMENTS 4,551,000 11/1985 Kanemitsu et al. ..... 355/210
4,619,514 10/1986 Ide ..... 355/327 X
4,669,856 6/1987 Yamada ..... 355/209
4,841,335 6/1989 Kohyama ..... 355/326 X
4,851,875 7/1989 Tanimoto ..... 355/209 X
4,873,549 10/1989 Tada et al. ..... 355/209 X
4,875,079 10/1989 Bisaiji et al. ..... 355/326 X
4,878,091 10/1989 Morita et al. ..... 355/326 X

*Primary Examiner*—A. T. Grimley
*Assistant Examiner*—Sandra L. Hoffman
*Attorney, Agent, or Firm*—Finnegan, Henderson, Farabow, Garrett, and Dunner

[57] ABSTRACT

A multicolor image forming apparatus having an apparatus body and plural kinds of processing devices such as a photoreceptor, an electric charger for providing electric charge on the photoreceptor, an image exposure device for performing image exposure corresponding to multicolor image information on the charged photoreceptor, a developing device including a plurality of developing sub-devices for developing a latent image formed on the exposed photoreceptor into a toner image, a cleaner for cleaning a toner remaining on the photoreceptor after the toner image has been transferred to a copy paper, a plurality of supply devices for supplying toner to each of the plurality of developing sub-devices, and a color process cartridge for accomodating at least the photoreceptor and the plurality of developing sub-devices among the plural kinds of processing devices.

15 Claims, 15 Drawing Sheets

MULTICOLOR IMAGE FORMING APPARATUS WITH SEPARATELY REMOVABLE AND INSERTABLE ASSEMBLY UNITS

BACKGROUND OF THE INVENTION

1. Field of the Invention

The present invention relates to a multicolor image forming apparatus for obtaining color copies by electrophotography in which a latent image formed on a photoreceptor is developed by a plurality of developing means including a multicolor developer.

2. Description of the Related Art

Many methods and apparatuses have been proposed to obtain color images by electrophotography. For instance, Japanese Patent Publication Open to Public Inspection No. 100770/1986 discloses a method for obtaining a color copy which will be explained as follows. Latent images corresponding to the number of decomposed colors of documents, are formed on a photoreceptor. The latent images are transferred onto a transfer drum every time development is conducted and multicolor images are formed on the surface of the transfer drum. After that, they are transferred onto a transfer paper. Color copies are obtained in the way mentioned above. According to this method, the apparatus needs to have a transfer drum having a circumferential surface onto which an image of document size can be transferred. It is unavoidable that the size of the apparatus becomes large and its structure becomes complicated.

For example, Japanese Patent Publication Open to Public Inspection No. 149972/1986 discloses a multicolor image forming apparatus which will be explained as follows. A latent image corresponding to the number of document image basic colors is formed on a photoreceptor and development is conducted. Multicolor copies are obtained by transferring the images onto a transfer paper every time development is conducted. It is difficult to accurately superimpose multicolor images by this method and a color copy with good quality can not be obtained.

There is a multicolor image forming method in which forming a latent image on a photoreceptor corresponding to the number of document image basic colors and development is repeated to superimpose color toner on the photoreceptor, then the color image on the photoreceptor is transferred onto a transfer paper. The basic process of this multicolor image forming method is disclosed in Japanese Patent Publication Open to Public Inspection Nos. 75850/1985, 76766/1985, 95456/1985, 95458/1985, and 158475/1985 by the applicants.

In the multicolor image forming apparatus to obtain color images by the method of superimposition mentioned above, a plurality of developing units containing different colored toner are located around the photoreceptor and the photoreceptor generally makes a plurality of revolutions to develop latent images on the photoreceptor, and color images are obtained.

Furthermore, the applicants offered a proposal to improve the work efficiency of a plurality of developing units with the object of simplifying the structure surrounding the photoreceptor of the above-mentioned color image forming apparatus by the applicants to make the apparatus compact and enhance its function. The content of the proposal is disclosed in Japanese patent application No. 89917/1986 which will be explained as follows. A frame which can contact to and detach from the photoreceptor is mounted on the apparatus. When the frame detaches from the photoreceptor, a plate mounted on the frame is pulled out and a developing apparatus mounted on the plate is removed for cleaning and to supply toner.

On the other hand, concerning a copier in general use, a proposal is offered as disclosed in Japanese patent Publication No. 54392/1983. The content of the proposal is as follows. A photoreceptor, a developing unit, and a cleaner are mounted on a support in a body with the object of making it easy to replace and maintain each unit. In the case of monochrome, all of these units are made in a body and they are disposable for easy replacement. That type of apparatus is disclosed in Japanese Patent Publication Open to Public Inspection No. 154255/1982. In the case of a disposable color cartridge, an apparatus in which a plurality of disposable developing units are built, is disclosed in Japanese Patent Publication Open to Public Inspection No. 72159/1983.

However, these apparatuses do not attain the level of the above-mentioned multicolor image forming apparatus with a plurality of developing units of multicolors and full colors in view of the point that the apparatus is compact and excellent in maintenance efficiency.

In the case where a plurality of developing units are located in the peripheral portion of the photoreceptor, toner flies in all directions in the apparatus during operation, more than in the case of a conventional copier. As a result, maintenance work must be conducted frequently.

On the other hand, the above-mentioned multicolor image forming apparatus in which a color image is obtained by superimposing toner images on the photoreceptor, is complicated in structure and large in size. It is especially necessary that the clearance between a plurality of developing units and the surface of the photoreceptor must be accurately maintained.

In order to take measures against these problems, a color process cartridge is considered a solution, wherein the color process cartridge is one body in which a photoreceptor, a plurality of developing units, and furthermore cleaning means are assembled. When a disposable color process cartridge with a plurality of built-in color developing units is to be used among the above-mentioned various kinds of multicolor image forming apparatuses, the color toner consumption of each developing apparatus is different from each other according to the kind of documents to be copied and especially according to the users. Especially the difference of consumption between black toner and other colored toner is remarkable. For that reason, it is disadvantageous that color cartridges with a plurality of built-in color developing units are used as disposable units. There are various kinds of problems in installing a photoreceptor and a plurality of the developing units, explained as follows (1) In the multicolor image forming apparatus for developing the above-mentioned general color images, superimposed color images, and the like, the arrangement and the shape of each developing unit differ from each other in view of the fact that each apparatus has a different structure. Therefore, when the photoreceptor is replaced, the developing unit is replaced, or when the developing unit is pulled out to replace toner, the photoreceptor is subject to damage. In order to prevent a developing unit of one color from scratching other color toner images developed on the photoreceptor, or to solve the problem of color mixing, a clearance adjusting mechanism must be installed in each developing unit which adjusts the clearance between the photoreceptor and the developing unit. When the bias must be changed, there are problems in the mechanism and in the time. Its structure is complicated and its operation and maintenance work are very troublesome and, furthermore, a great number of parts are needed in the apparatus. As a result, the apparatus tends to lack reliability.

(2) There is a method which has been known as the rotary developer. In this method, the developing unit which is located at a prescribed position of a body of rotation, is rotated by a prescribed angle to develop each color at a fixed position every time each color is developed. In this method, it is difficult to stop the developing unit at a prescribed position with accuracy. Especially in the non-contact developing method, the mechanism to adjust the clearance (D sd) between the photoreceptor and the developing sleeve is complicated and it is hard to set the photoreceptor and the developing sleeve accurately. Furthermore, it takes time to rotate the developing units, therefore it is difficult to conduct development at a high speed because of the restriction of time.

(3) The variation of the development characteristics is one of the factors which degrades the image quality. The variation of the development characteristics is caused by the fluctuation of D sd stemming from the fluctuation of the diameter of the photoreceptor according to the difference of the temperature between the inside and outside of the apparatus, or the fluctuation of D sd according to the vibration of the inside or outside of the apparatus caused by the machines rotation. Actually, the fluctuation of D sd is required to be ±0.02 to 0.03 mm. However, the eccentricity of the photoreceptor shaft is usually ±0.005 to 0.01 mm. When the photoreceptor is installed in the apparatus, the clearance between the surface of the photoreceptor and the developing unit is ±0.1 to 0.3 mm. When the apparatus is in operation, the fluctuation of the temperature inside the apparatus is 5° to 35° C. According to the fluctuation of the temperature, the photoreceptor now in use, made from aluminum expands and contracts by ±0.01 to 0.2 mm. The expansion and contraction of the photoreceptor affect the quality of the image, causing mixing and imbalance of color, in combination with the fluctuation of voltage which is caused by the difference of the relationship of positions of the developing unit, the electrifying unit, and the exposure unit.

The main problems to be solved by the present invention are as follows.

(4) Previously, the applicants invented and proposed a method which is disclosed in Japanese patent application Nos. 181792/1986, 89048/1986, and 89917/1986. The method will be explained as follows. As a developing garage, a unit box is installed on a frame on which a plurality of developing units are mounted being integrated into one body. When the individual developing unit is removed, the developing garage on which a plurality of developing units are mounted is once removed from the photoreceptor drum, then the individual developing unit is pulled out from the garage. The problem of this invention is when the individual developing unit is removed, toner is scattered, and scattered toner drops into the apparatus and causes mixing of colors.

(5) The applicants improved the invention which was disclosed in the above-mentioned Japanese patent application Nos. 18172/1986 and 89048/1986, and applied for a patent of Japanese patent application Nos. 234494/1987, 294918, and 320597/1987. In these patents the applicants proposed a color image forming apparatus the details of which will be described as follows. Various process units mainly consisting of a plurality of developing units, a cleaning unit, and the like are mounted on the apparatus equipped with a photoreceptor, together with a slidable frame which is capable of being pulled out and pushed in quickly. Each developing unit which can be dismounted from a toner hopper mounted on the apparatus, can be replaced for maintenance.

However, this invention did not reach a higher level than a disposable color developing unit cartridge in which the individual developing unit is replaced according to the consumption of toner, in order to show consideration for promoting customer's merit and making the apparatus compact.

SUMMARY OF THE INVENTION

The principal object of the present invention is to solve the problems described above.

The above-mentioned principal object of the invention can be attained by a multiple color image forming apparatus which will be explained as follows.

A multicolor image forming apparatus which has a photoreceptor, an electrification means or a charging means for charging the photoreceptor, an exposure means for exposing the images on the photoreceptor according to the multicolor information, a developing means for developing an electrostatic latent image formed on the photoreceptor by the exposure means, a cleaning means for cleaning the residual toner which remains on the photoreceptor after transfer of images is conducted, and a toner supplying means for supplying toner to a plurality of developing units, the apparatus further comprising: a color process cartridge which holds at least the photoreceptor and a plurality of developing units and can be removed from and installed in the apparatus; and a guide means and a connection means for removing the individual developing unit from the color process cartridge and installing the individual developing unit in the color process cartridge.

The present invention is organized to solve the above-mentioned problems. The characteristics of the construction of the multicolor image forming apparatus of the present invention are as follows.

(1) The individual color developing unit is capable of being mounted on the color process cartridge and dismounted from it.

(2) Furthermore, the individual developing unit is capable of being replaced easily.

(3) It is preferable that all developing units in which one component developer or two component developer is used, are disposable.

(4) Otherwise, color developing units, except a black toner developing unit, are one-component developer units and they are disposable.

(5) In the case where all developing units are two-component developer developing units, all the developing units are capable of being mounted and dismounted to supply toner because the useful life of the carrier is limited.

(6) When maintenance is conducted such as replacing a disposable developing unit, supplying toner, cleaning the apparatus, and the like, each color developing unit is located at the proper position accurately with regard to the photoreceptor. This matter is important to obtain excellent images especially in the multicolor image forming apparatus in which the non-contact developing method is used to superimpose toner images.

(7) To be more specific, a guide means to mount the developing unit on the color process kit and to dismount the apparatus from it, a gap adjusting means to adjust the gap between the photoreceptor and the developing unit when it faces the photoreceptor, and a lock means which makes the developing unit come into contact with the photoreceptor with pressure and locate the developing unit at a proper position accurately, are installed.

(8) A guide unit, for instance a guide rail, which stably holds the developing unit at both sides of the developing unit engages with not less than two guides, for example guide grooves on the surface which meet at right angles with the shaft of the photoreceptor installed in the frame of the color process cartridge. The individual developing unit is inserted into the cartridge and held by this engagement. The problems are solved by the measures mentioned above.

Furthermore, in the present invention, a plurality of developing units are combined with a compact and thin type of toner supplying hopper by which excellent images can be obtained without affecting the high quality of images. The main portion of the developing unit housing can be used in common among not less than two developing units. To be more specific, compact and thin developing units are horizontally stacked in parallel with the photoreceptor shaft. Preferably, the height of a plurality of stacked developing units should be less than the diameter of the photoreceptor. Furthermore, the photoreceptor and a plurality of developing units are mounted on a cartridge which can be pulled out from the apparatus.

(9) The complicated layout of developing units can be eliminated. Because the developing units are in a stack and not less than two developers are used in common, it is very easy to operate and maintain the apparatus even when a plurality of developing units are handled. Furthermore, the operation and mechanism become more simple because horizontally stacked developing units can be pulled out in parallel with each other when maintanance is conducted. Since developing units are mounted on the support member being integrated into one body, the cartridge can be pulled out from the apparatus and a plurality of developing units can be pulled out horizontally in parallel with each other (in the direction transverse to the photoreceptor drum pulling out direction). For that reason, maneuverability of the apparatus is improved, complicated mechanisms can be eliminated, and maintenace work becomes simple. Besides the advantageous points mentioned above, the cost can be cut down by methods such as using a plurality of common developing units, using similar parts in common, making the apparatus compact, and making the structure of the parts simple. These advantageous points lead to decreasing the number of parts. As a result, reliability of the apparatus is increased.

(10) Since the apparatus is structured as mentioned above, the gap between the surface of the photoreceptor and the adjoining developing units is approximately uniform and small, and the distances from the elecrifying and exposing positions on the photoreceptor to each developing unit can be reduced. Therefore, the influence caused by the difference of electric potential damping according to the slippage of each developing unit, can be reduced. Since the support member integral with other parts is mounted on the apparatus, the influence caused by vibration and shock can be reduced. Especially when images are superimposed by the multirevolution method, mixing of color and degradation of color balance caused by the fluctuation of D sd and imposed bias potential at non-contact development, can be prevented to obtain a higher quality image.

The second object of the present invention will be described as follows.

When monochrome images are continuously processed by monochrome developer in the above-mentioned image forming apparatus, the single color process unit in which one developing unit contains a lot of black developer, can be used instead of the above-mentioned multiprocess unit.

As far as the monochrome process unit is concerned, the frequency in use of each part is common and the service life is equal, so a simple developing unit which is fixed to the cartridge together with the photoreceptor and closed in the cartridge, is used. However, in the case of the multicolor process unit, the frequency of use of developing units is far less compared with that of the photoreceptor. Accordingly, if the developing units are made integral with the cartridge, each part differs in its service life, which is disadvantageous. Furthermore, there is a problem that the developing conditions for adjusting the image color balance can not be selected for each unit.

In the present invention, the problems mentioned above have been solved. It is the second object of the present invention to provide a color image forming apparatus in which, when monochrome images are processed, the closed type monochrome process unit in which there is no possibility that developer flows out is used, and when color images are processed, a color image forming apparatus is used in which a multicolor process unit having stable efficiency in color image processing and being capable of color balance adjustment can be used.

The second object of the present invention is attained by a color image forming apparatus characterized in that the apparatus can be interchangeably equipped with a process unit organized in a body having a photoreceptor and one developing unit, and a process unit having a photoreceptor and a plurality of color developing units.

The third object of the present invention will be explained as follows.

In a conventional electrostatic copier, the means relating to image forming wears out, degrades, and finally reaches its working limit. Generally speaking, it is difficult for customers to judge whether the image forming means has reached the working limit or not. For that reason, customers tend to excessively use the apparatus, exceeding the working limit. Therefore, the quality of copied images is always unstable and maintenance work served by the makers is troublesome. As a matter of fact, it is difficult to maintain quality assurance.

Furthermore, copiers are overworked. Overwork exerts a harmful effect upon their sevice life.

In order to take measures against the situation, the methods which will be described later are disclosed in Japanese Patent Publication Open to Public Inspection Nos. 202459/1983 and 34548/1984. The methods are as follows. The image forming means which wears out and degrades gradually, such as a photoreceptor, a developing unit, a cleaning unit, and the like are assembled in the form of a process cartridge. The cartridge is installed in the apparatus being capable of being mounted and dismounted quickly. Judging from the volume of the toner enclosed in the above-mentioned developing unit, the service life can be predicted and after being used for a certain amount of time, the above-mentioned cartridge is pulled out from the apparatus and disposed of. On the other hand, the following copier is disclosed in Japanese Patent Publication Open to Public Inspection No. 72159/1983. The disclosed copier has a process cartridge in which a photoreceptor, an electrifying unit, a plurality of developing units, a cleaning unit, and the like are installed. In this copier, the above-mentioned process cartridge can be interchanged only with the process cartridge including a monochrome developing unit. The two component developer consisting of non-magnetic toner and magnetic carrier is superior in image quality to one component developer containing magnetic materials. The reason the image is clearer is because the coloring agent in the toner does not cause muddiness in the case of a two-component developer.

As compared with the monochrome process cartridge, the color process cartridge including a plurality of developing units is complicated in structure and expensive. In the case where the color process cartridge is disposed of according to the volume of the toner enclosed in the developing unit, the cost will be increased and this type of color cartridge is not practical. In the case of the color process cartridge, the toner consumption depends on the developing units. Therefore, it is difficult to determine the developing unit whose toner volume is to be used as the standard. If the process cartridge is disposed of from the standard established according to the developing unit whose toner has been used up first, the cost will further increase and the apparatus loses its practicality.

The third object of the present invention is to provide a color image forming apparatus characterized as follows. A plurality of developing units installed in the color process cartridge can be replaced individually according to the consumption of toner. Therefore, the above-mentioned color process cartridge can be disposed of in the range of practical cost allowance.

The above-mentioned object can be attained by the color image forming apparatus with a process cartridge in which a photoreceptor and a plurality of developing units are installed and the above-mentioned plurality of developing units can be replaced respectively according to the consumption of toner.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate presently preferred embodiments of the invention and together with the description, serve to explain the principles of the invention.

FIG. 8(*a*) is a side view of the cartridge on the developing unit side.

FIGS. 8(*b*), 8(*c*), and 8(*d*) are partial sectional views which show the state of engagement of the developer with the cartridge.

DETAILED DESCRIPTION OF THE PREFERRED EMBODIMENTS

Reference will now be made in detail to the presently preferred embodiments of the invention, examples of which are illustrated in the accompanying drawings. Wherever possible, the same reference numbers will be used throughout the drawings to refer to the same or like parts.

EXAMPLE TO ATTAIN THE PRINCIPAL OBJECT OF THE INVENTION

As one of the examples disclosed by the applicants in Japanese Patent Publication Open to Public Inspection No. 75850/1985, a multicolor image forming apparatus will be explained as follows in which the multicolor image forming method by toner superimposing developing system is used.

Figure 1:
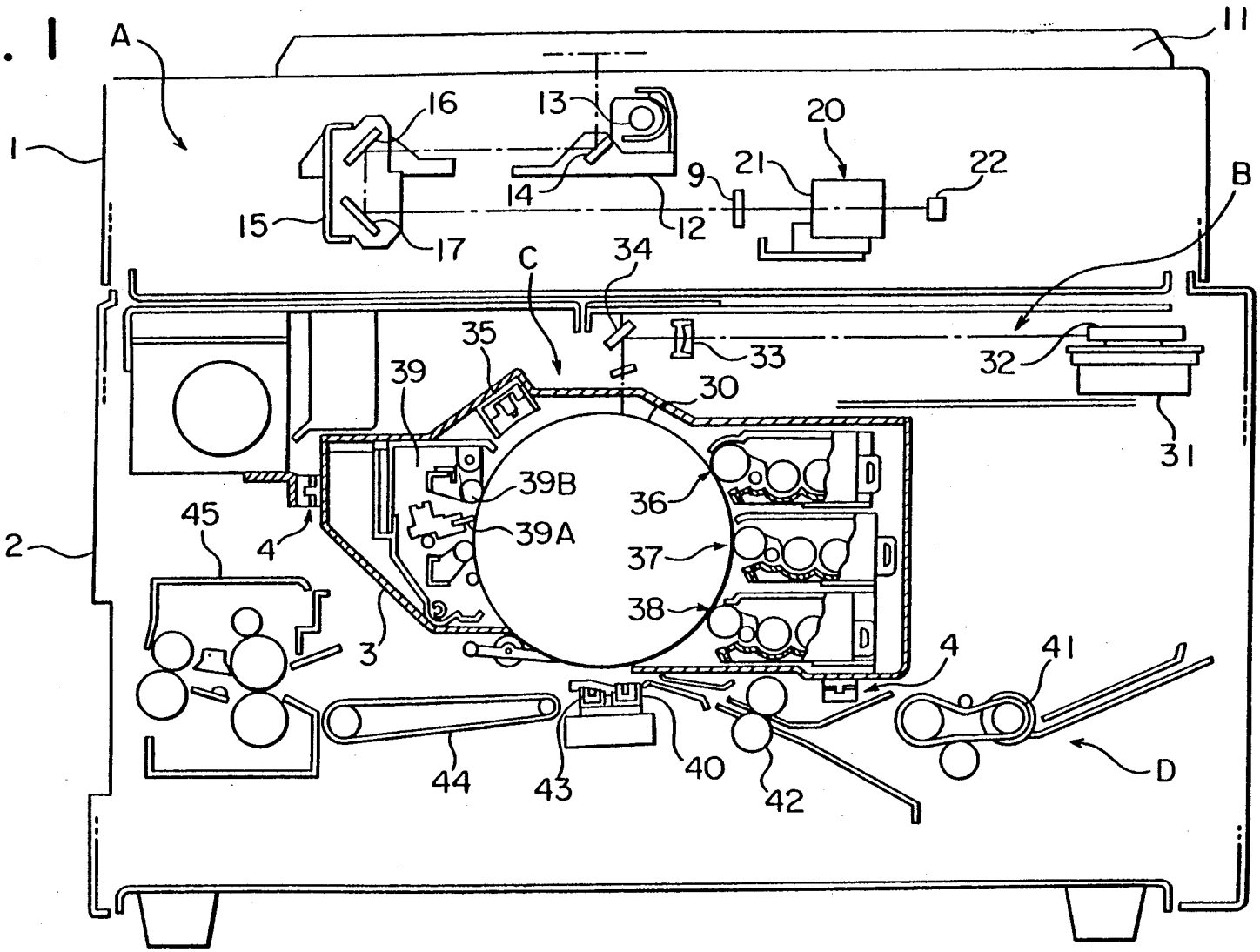
FIG. 1 is a sectional view of an example of a multicolor image forming apparatus of the present invention.

FIG. 1 shows the main structure of the multicolor image forming apparatus. The letter A is the image reading system. The letter B is the unit of the laser writing system. The letter C is the image forming unit. The letter D is the paper feeding unit. In this apparatus, a color image is formed by the following process.

The numeral 11 in the image reading system A is a document stand. A document on the stand 11 is exposed by the halogen lamp 13 mounted on the carriage 12 which slides horizontally. The mirrors 16 and 17 are mounted on the movable mirror unit 15 which can slide horizontally in the same way as the carriage 12. The mirrors 16 and 17 in combination with the mirror 14 mounted on the carriage 12 send an optical image to the lens reading unit 20. The carriage 12 and the movable mirror unit 15 are driven by a stepping motor (not shown in the drawing) through a wire (not shown in the drawing). The carriage 12 slides at the speed of V and the movable mirror unit 15 slides at the speed of ½ V in the same direction.

The above-mentioned lens reading unit 20 consists of the lens 21 and the color CCD 22.

The optical images of the document which were transmitted by the mirrors 14, 16, and 17 are focused by the lens 21 and the images are formed on the acceptance surface of the color CCD 22.

When color images are copied by the color image forming apparatus of the example, the multicolor process unit is used, which will be explained later. The copy mode change-over device comes into operation by setting the multicolor process unit to the device and image processing by the above-mentioned apparatus is switched to the color copying process.

When the document put on the platen glass 11 is read by the color CCD 22 of the image reading unit in the color copy mode, color separation is conducted through the filter 9. For instance, the filter 9 is composed of the filter R, the filter G, the filter B, and the filter ND. The document is read after the optical images of the document passed through either the filter R, the filter G, the filter B or the filter ND. A filter is selected from among the filter R, the filter G. the filter B, and the filter ND by the filter selecting device which can move the filters in the vertical direction of the surface of the drawing. The filter R passes red light, the filter G passes green light, and the filter B passes blue light. The filter ND is a neutral filter which passes all three colors. The image signal of blue, green and red outputted from the color CCD 22 is processed in a process of color correction at the signal processing unit. The color signal corrected according to the toner color of yellow, magenta, and cyan is outputted from the signal processing unit, then it is inputted to the laser writing unit B which is a means of exposure.

In the laser writing unit B, the laser beam generated by the semiconductor (not shown in the drawing) is scanned rotatively by the polygonal mirror 32 and its optical path is bent by the mirror 34 through $f\theta$ lens 33, and then scans the circumferential surface of the photoreceptor 30, upon which is impressed an electric charge beforehand by the electrifier 35 which is a means of electrification or a charging means.

When the scan is started, the laser beam is detected by the index sensor and the beam modulation by the first color signal is started. The modulated beam scans the circumferential surface of the photoreceptor 30. Therefore, the latent images corresponding to the first color are being formed on the circumferential surface of the photoreceptor 30 by the main scan conducted by the laser beam and the secondary scan conducted by the rotation of the photoreceptor 30. The latent images are developed by a developing means, for example the developing unit 36 loaded with yellow (Y) toner and toner images are formed on the surface of the photoreceptor drum. The obtained toner images are held on the surface of the drum and pass under the cleaning unit 39 which is separated from the photoreceptor 30, then the next copy cycle is started.

The photoreceptor 30 is charged again by the electrifier 35, then the second color signal outputted from the signal processing unit is inputted into the writing system unit B, and the second color signal is written on the drum surface and the latent images are formed in the same way as the first color signal mentioned before. The latent images are developed by the developing unit 37 which is loaded with magenta (M) toner as the second color.

The magenta (M) toner images are formed while the above-mentioned yellow toner images exist on the surface of the photoreceptor.

The numeral 38 is a developing unit which is loaded with cyan (C) toner and it forms cyan (C) toner images on the drum surface according to the image signal generated in the signal processing unit. A.C. current bias and D.C. current bias are impressed on the sleeves of the developing units 36, 37, and 38, and toner projection development is conducted by two component developer to visualize the images. Non-contact development is carried out on the surface of the grounded photoreceptor 30 in this way.

The color images formed on the circumferential surface of the photoreceptor 30 are transferred at the transfer pole 40 installed in the apparatus as a transfer means to a recording paper, a recording medium, which was conveyed from the paper feed unit D by the paper feeding belt 41 and the paper feeding roller 42. The recording paper on which toner images are transferred is separated from the drum surface by the separation pole 43, conveyed by the conveyance belt 44 to the fixing unit 45, and fixed.

After the recording paper was separated from the surface of the photoreceptor 30, the blade 39A of the cleaning unit 39 comes into contact with the surface and removes the residual toner. After the residual toner is removed, the blade 39A is separated from the drum surface and the next color image forming process is started.

The layout of the main units composing the apparatus will be explained as follows. The image reading system A is installed in the frame work 1 for exclusive use and mounted on the main body which will be described later.

The image recording system which is composed of the writing system B, the image forming unit C, the paper feeding unit D. and the like, is installed in the main body 2 and receives the color signal from the image reading system A through a flexible harness connected with the frame work 1.

In the main body 2, the photoreceptor 30 is located approximately in the center and the developing units 36. 37, and 38 are horizontally located on the right side of the circumferential surface of the photoreceptor 30. The electrifier 35 and the cleaning unit 39 are located on the left side of the circumferential surface of the photoreceptor.

The photoreceptor 30, the developing units 36, 37, 38, and the cleaning unit 39 are not directly installed on a pair of base plates fixed to the main body 2, but are installed on the cartridge 3 which is capable of being mounted on the main body or dismounted from it. They are installed on the cartridge 3 which is supported by a bearing or capable of being interchanged quickly.

Figure 9A:
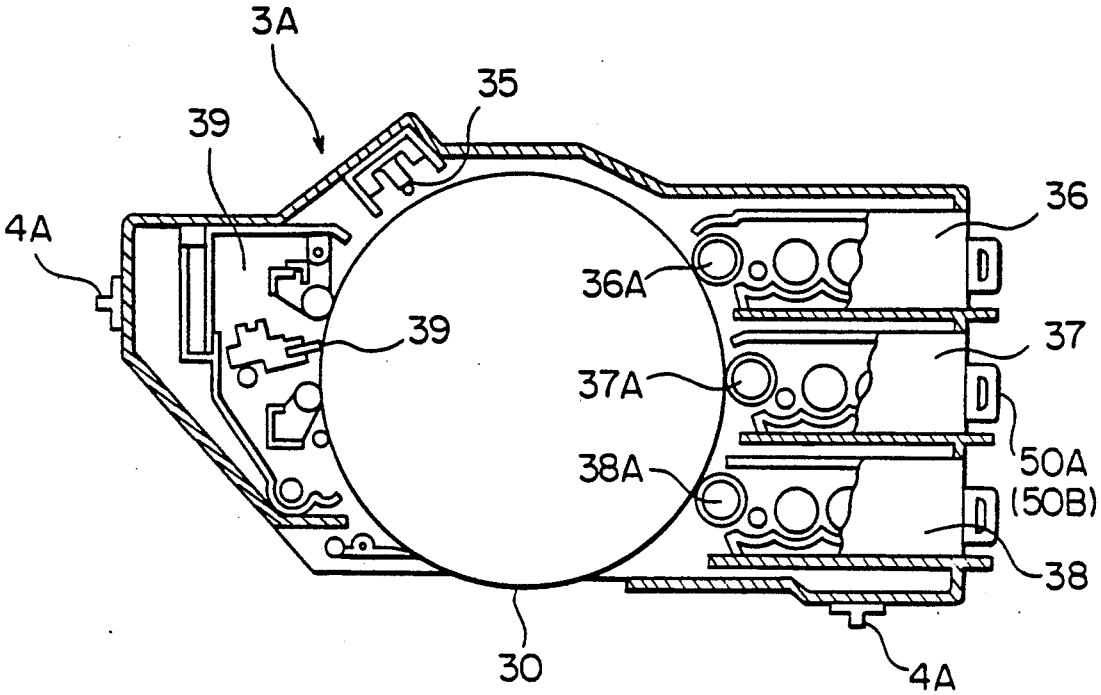
FIG. 9(*a*) and FIG. 9(*b*) are sectional views of the multiprocess unit and the monochrome process unit used in the above-mentioned apparatus.
Figure 9B:
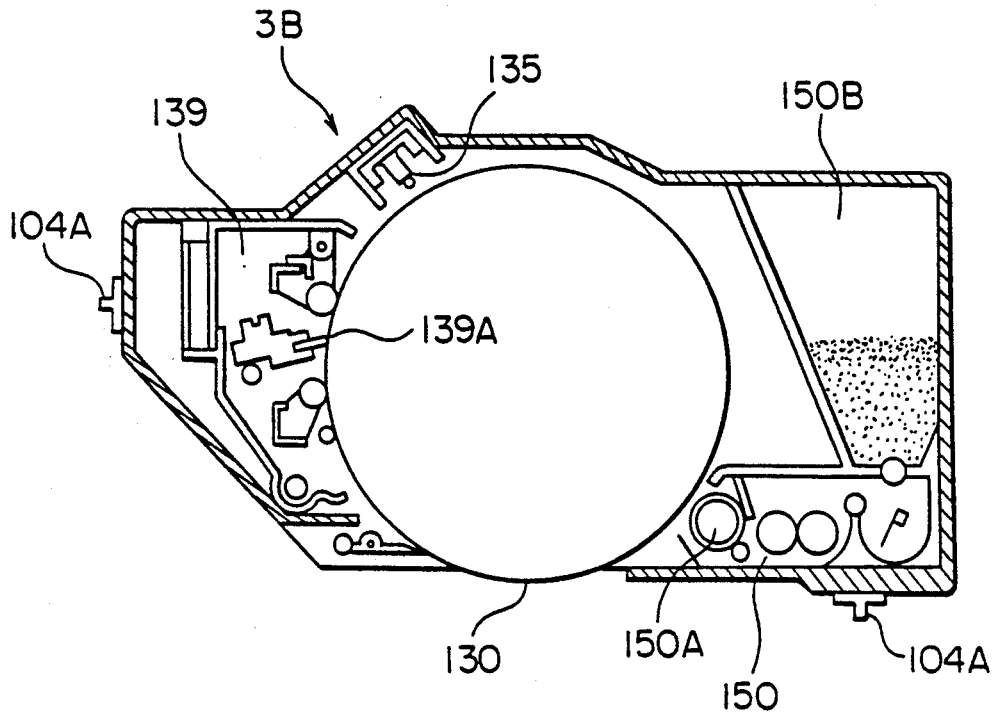

In the case where a plurality of developing units for various colors are used, as explained in this example, the cartridge 3 is composed of the multicolor process unit 3A integrating the photoreceptor drum 30, the electrifier 35, and the developing units 36, 37, 38 into one body as shown in FIG. 9(*a*).

Figure 6:
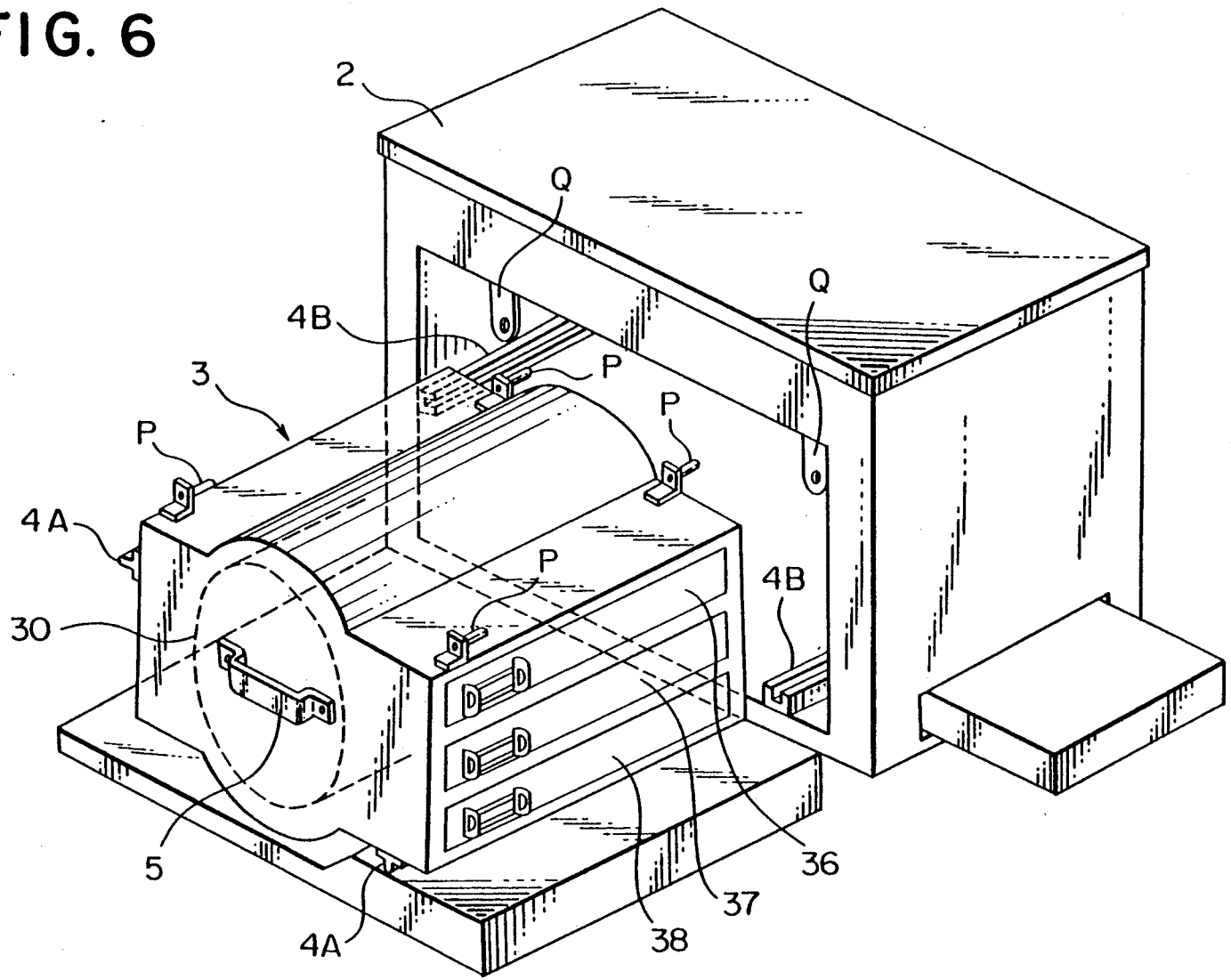
FIG. 6 is a perspective view of a cartridge which is pulled out of the apparatus.

As shown in FIG. 6, the skeleton of the cartridge 3 consists of three similar panels (not shown in the drawing) which are integrated into one body with stays and the like. The cartridge 3 can be easily mounted on the main body 2 and dismounted from it with a pair of guide members 4 which are located on the right and left sides. The rails 4A are located on the right and left edge of the cartridge 3 and the guide rails 4B are fixed at the position of the main body 2 corresponding to the rails 4A. Since the rails 4A engage with the guide rails 4B, the cartridge 3 can slide in the main body and be mounted and dismounted quickly.

At the rear of the above-mentioned panel, close to both upper edges, a pair of standard pins P are mounted. The pins P engage with the holes in the hanging portions Q which are mounted on the plate fixed to the main body 2. The cartridge 3 is hung by the pins P which engage with holes as explained above. The photoreceptor 30, developing units 36, 37, 38, and the cleaning unit 39 which are mounted on the cartridge 3, are located properly by the engagement of the pins with the holes.

Accordingly, when the handle 5 mounted on the front panel is pulled, the cartridge 3 slides out of the main body 2 on the guide rail 4B. When the handle 5 is pushed in, the pins P engage with the holes in the hanging portions Q and the cartridge 3 is hung by the pins again. The cartridge 3 is set in the main body 2 in this way.

Since the cartridge 3 is suspended by pins P from the plate composing the main body 2, vibration and shocks caused by a motor and the like mounted on the main body 2, and transmitted to the photoreceptor 30, developing units, and the cleaning unit, are remarkably reduced and absorbed. Even if a little vibration or shock is transmitted, each piece of equipment receives vibration or shock uniformly. For example, a plurality of developing units and the photoreceptor are held relatively at the same position. Therefore, there is no problem in forming images.

It is especially advantageous to integrate the photoreceptor 30 and the cleaning unit 39 into one body on the cartridge 3. The reason is that when image forming is conducted by superimposing development, in the cleaning unit, the blade 39A and the second cleaning roller 39B which scrapes the residual toner from the blade must be adjusted accurately. To be more specific, when the blade or the roller comes into contact with the photoreceptor or the blade with pressure, the pre$sure must be adjusted very accurately and the state of contact must be very delicate and precise. Accordingly, when the photoreceptor 30 and the cleaning unit 39 are mounted firmly on the cartridge 3, influence caused by vibration or shock is eased and absorbed.

When the superimposing image forming process is adopted, the circumferential length of the photoreceptor 30 must be the length of the largest recording paper size B4 or the paper size A3 plus a little margin, and the outer diameter needs to be at least 130 mm to 150 mm. When the size of a transfer paper is A4, the diameter of the photoreceptor drum must be 80 to 110 mm. In this example, a photoreceptor diameter of which was 110 mm was used.

Concerning developing units 36, 37, 38, the details about them will be described later. The outer diameter of the developing sleeve can be reduced to 20 mm and the thickness (height) of the developing units can be reduced to not more than about 30 mm without degrading image quality. As a result, when color image forming is conducted, 3 to 4 developing units, in this example developing units 36, 37, 38, are used and they are stacked horizontally in the space around the photoreceptor 30 whose outer diameter is mentioned above.

Accordingly, even if the size of the cartridge 3 is restricted to a size just large enough to cover the photoreceptor 30 in order to avoid affecting the layout of the members which are directly fixed to the main body 2, such as the laser writing system B located at the upper position, the transfer pole located at the lower position, and the separation pole and other conveyance system members, the cleaning unit 39 and a plurality of developing units 36, 37, 38 can still all be installed. Therefore, the recording paper path is composed approximately straight, and jamming of recording papers can be prevented. Even when jamming occurs, it is easy to solve the problem.

The structure of the developing units 36, 37, 38 are as follows.

Since the developing units 36, 37, 38 of the example have the same structure, the developing unit used in the present invention will be explained with the sectional view of the developing unit 37 shown in FIG. 2.

The numeral 30 is a photoreceptor. The numeral 3702 is a housing. The numeral 3703 is a developing sleeve. The numeral 3704 is a magnetic roller. The numeral 3705 is a rigid and magnetic cylindrical rod which controls the volume of developer. The numeral 3715 is a holder which holds the cylindrical rod 3705. The numeral 3706 is a spring to make it possible to convey developer by the pressure between the cylindrical rod 3705 and the developing sleeve 3703. The cylindrical rod 3705 is pressed to the developing sleeve 3703 with a constant force when developer does not exist. The numeral 3707 is the first stirring member and the numeral 3708 is the second stirring member. The numeral 3709 is a feeding roller. The numeral 3710 is a scraper. The numeral 3711 is a partition plate for stirring. The numeral 3721 is a toner supply unit. The numeral 3722 is a rotor for supplying toner. The numeral 3723 is a sponge roller. The numeral 3750 is a handle. Toner contained in the toner supply unit 3721 is supplied to the developer stirring unit by the rotating toner supply rotor 3722 and the sponge roller 3723.

Toner supplied to the stirring unit is completely stirred and mixed with carrier by the first stirring member 3707 and the second stirring member 3708 which rotates in the opposite direction of the first stirring member. After that, toner mixed with carrier is conveyed as developer to the developing sleeve 3703 through the supply roller 3709.

The first stirring member 3707 and the second stirring member 3708 are constructed with a lefthand screw thread and rotate in opposite directions. Toner and carrier which were conveyed to the inner part of the stirring member by the thrust of the second stirring member 3708, get over the partition plate whose height is low at the inner part and move toward the first stirring member 3707 side. Then, toner and carrier are conveyed to the first stirring member 3707 side by the thrust of the first stirring member. Toner and carrier are electrified by triboelectric charging during the mixing action and become uniform developer which is electrified by triboelectric charging. Developer adheres to the circumferential surface of the developing sleeve 3703 from the sponge feeding roller 3709 which rotates in the direction indicated by the arrow.

Figure 2:
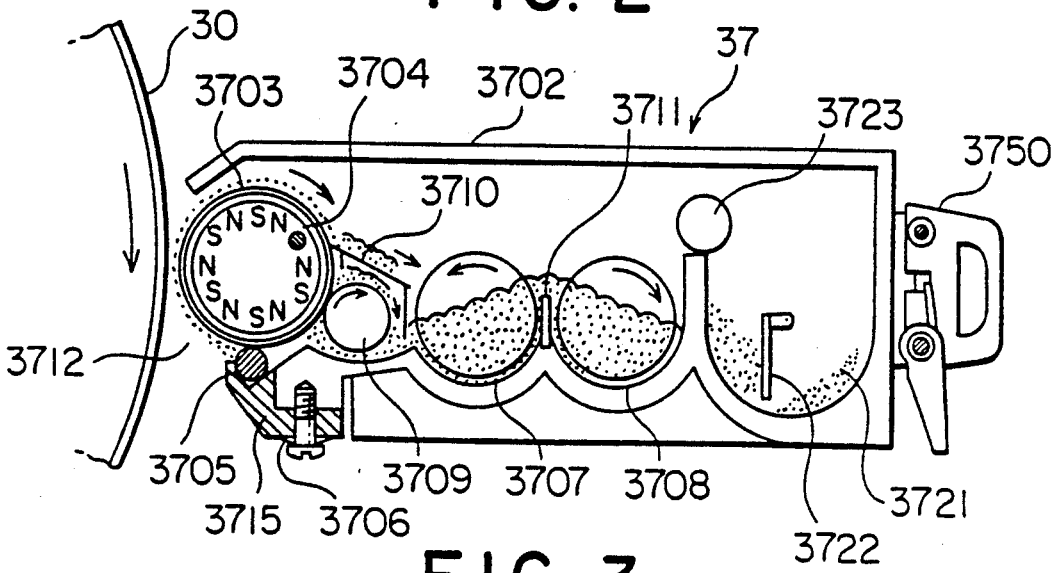
FIG. 2 is a sectional view of a developing unit used in the multicolor image forming apparatus of the present invention.

The developer used in the example in FIG. 2 is shown in the following table.

TABLE 1

| Developer | Conditions: Weighted mean particle diameter μm | Specific resistance ucm | Electro static charge μc/g | Toner density wt % |
|---|---|---|---|---|
| Carrier | 45 | Not less than $10^{14}$ | Ferrite particles having magnetization strength of 20 emu/g coated with copolymer of MMA/st | |
| Toner | 3 | Not less than $10^{14}$ | −15 | 7 |

Figure 3:
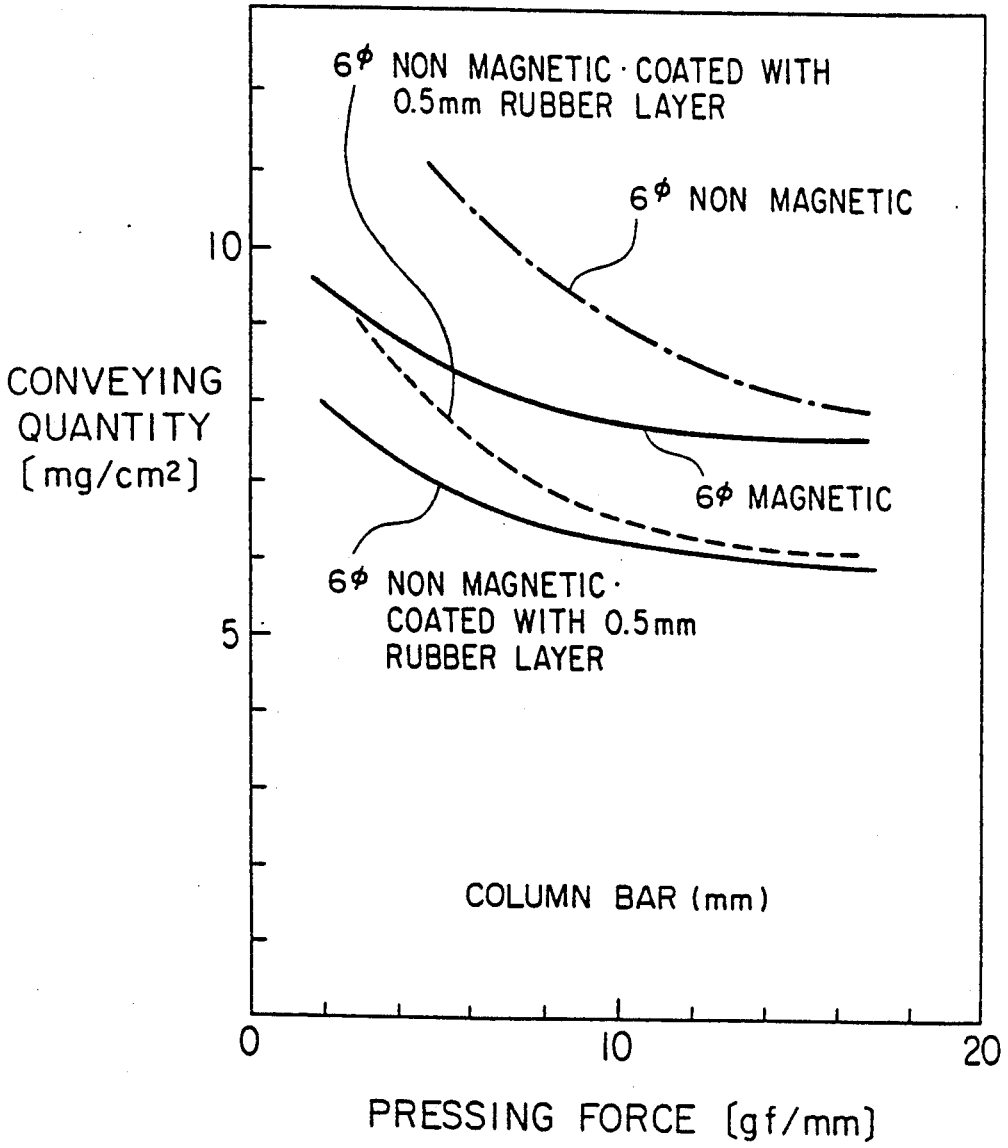
FIG. 3 and FIG. 4 are graphs which show the relation between the pressure of a cylindrical rod and the transported volume of developer.

When a cylindrical rod made from a rigid magnetic SUS (stainless steel) having a diameter of 6 mm was used as the cylindrical rod 3705 and a load of 2 to 6 gf/mm was given to the cylindrical rod 3705 at the position facing the pole of the magnetic roller 3704, the developer conveyance volume of 7 to 9 mg/cm$^2$ was uniformly obtained. As a result, stable images with even density were obtained. When this experiment was made, magnetic flux density at the pressed position on the surface of the developing sleeve 3703 was 600 gauss. FIG. 3 shows the results of a comparison between the volume of conveyed developer when the magnetic cylindric 1 rod 3705 was used and also when a non-magnetic stiff cylindrical rod with a diameter of 6 mm was used instead of the cylindrical rod 3705.

Figure 4:
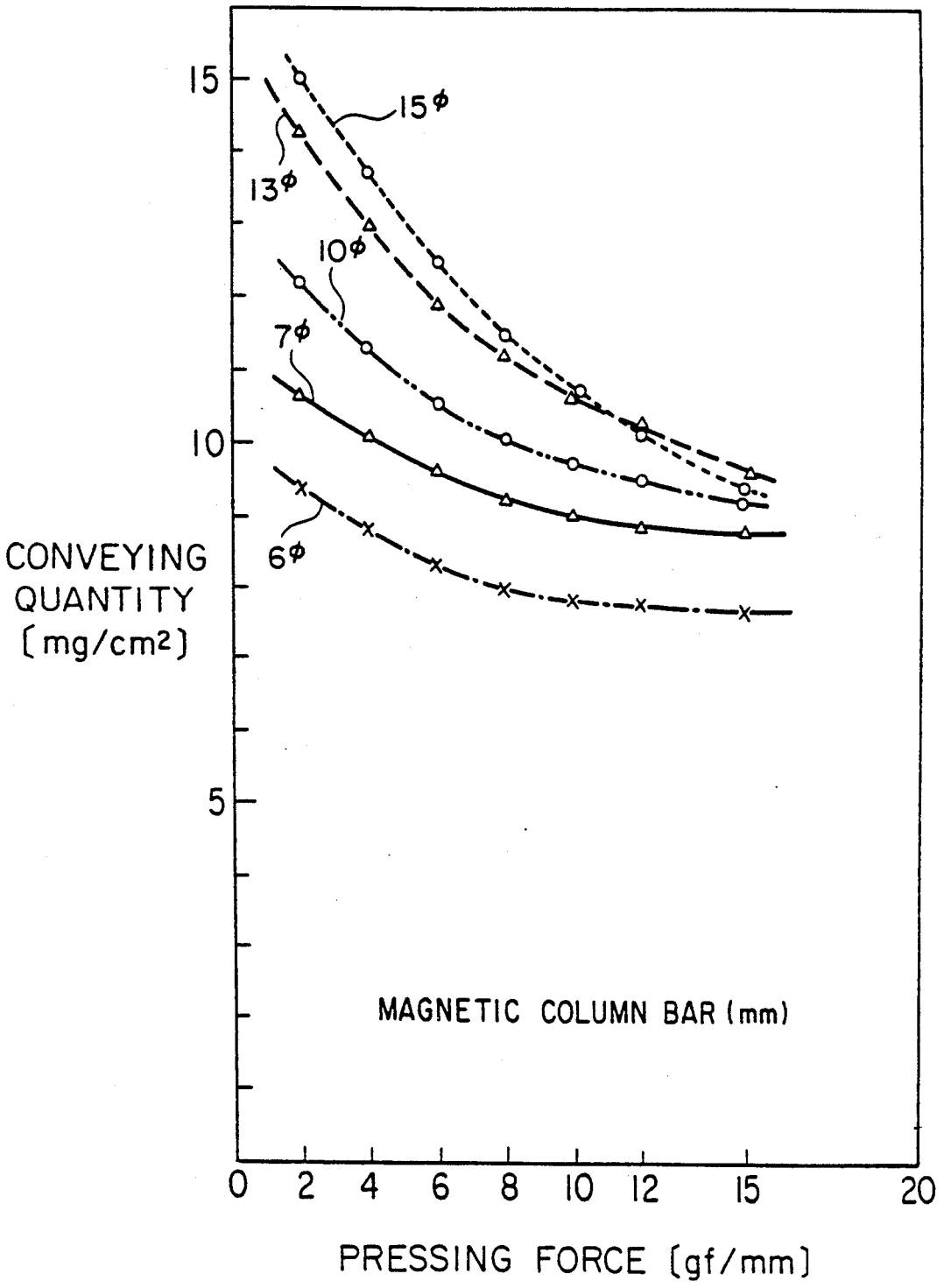

Concerning the volume of conveyed developer when the rigid magnetic cylindrical rod 3705 was used, the relation between the pressing force and the developer conveyance volume when the diameter of the cylindrical rod was changed, was obtained as shown in FIG. 4. The proper conveyance volume can be selected according to the graph. Especially when the radius of the cylindrical rod was 0.5 to 15 mm, an adequate balance was maintained between the force which the developer exerted on the cylindrical rod 3705 and the force which the cylindrical rod 3705 exerted on the developing sleeve 3703, and a stable conveyance volume was obtained. More preferably, when the radius of the cylindrical rod was 1 to 10 mm, the fluctuation of the conveyance volume was very little in spite of the fluctuation of the pressing force, and a uniform and thin layer of developer was obtained on the surface of the developing sleeve.

Non-magnetic stainless steel was used as the material of the stiff developing sleeve 3703 in this experiment. The same results were obtained when rigid materials such as aluminum, hard resin, glass, ceramic, and the like were used. Surface roughness of the developing sleeve 3703 wa 3S. When a developing sleeve with a surface roughness 0.1 to 20S was used in the experiment, the same effect was obtained.

According to the above-mentioned explanation, it has been proved that on the developing sleeve 3703, a uniform and stable layer of 100 μm to 450 μm, preferably 150 μm to 400 μm, is formed, extending over a long time.

In this example, a thin layer of developer which adheres to the circumferential surface of the developing sleeve 3703, being located outside the fixed magnetic roller 3704 and rotating in the direction indicated by the arrow (clockwise), develops in the developing region 3712, without contacting the surface of the photoreceptor, 30, the latent images on the photoreceptor which rotates in the direction indicated by the arrow and the toner images are formed.

Figure 5:
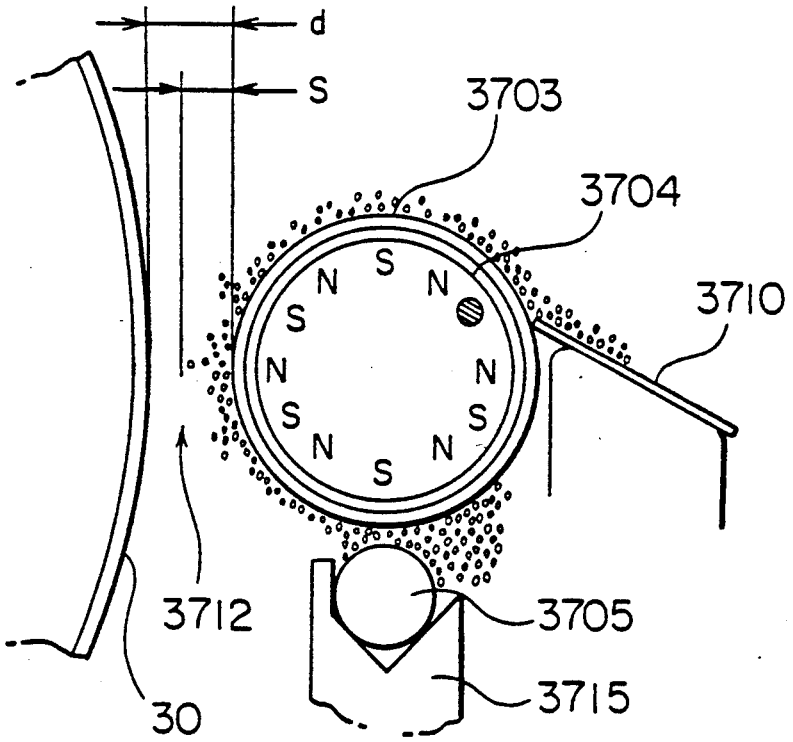
FIG. 5 is an enlarged partial sectional view of a developing unit.

As shown in FIG. 5, a layer of developer which is formed in the example shown in FIG. 2 looks like bristles near the developing region. When d is defined as the nearest distance between the developing sleeve 3703 and the photoreceptor 30 and S is defined as the height of bristles formed by the developer, d>S is the condition of a non-contact developing system.

In this non-contact developing system, bias including an AC component is given to the developing sleeve 3703 from the power source not shown in the drawing. As a result, only toner in developer on the developing sleeve 3703 selectively moves to the latent images on the photoreceptor 30 and adheres to them.

The developer, in which the toner component has been consumed and the carrier concentration has become high, is conveyed by the developing sleeve 3703 and scraped off by the scraper 3710 to be collected, then mixed again with developer whose toner concentration is high.

The specification of each member of the developing apparatus shown in FIG. 2 is as follows.

The developing sleeve 3703 is a thin walled pipe made from stainless steel whose outer diameter is 20 mm and outer surface is honed, thereby its surface roughness is 3 μm. It is rotated at a speed of 200 to 300 rpm. In this example, it is rotated clockwise at a speed of 250 rpm. It is desirable that the diameter of the developing sleeve 3703 is small in view of making the apparatus compact. But the diameter is determined to be 15 to 30 mm because of magnetic force limitations, as magnetic force is produced by the magnetic roller 3704 which is positioned in the developing sleeve 3703. Various kinds of experiments were made as to the number of rotations of the developing sleeve. When the number of rotations is small, the quantity of supplied developer is little and image density is low when the latent image is developed. In the case of a developing sleeve whose outer diameter is 20 mm, while the number of rotations is 0 to 200 rpm, the maximum image density increases linearly. However when the number of rotation is not less than 200 rpm, the image density is saturated. But when the environmental temperature is low, the maximum image density becomes low. Therefore, the number of rotations must be set taking into consideration this fact.

As shown in FIG. 2, the magnetic roller 3704 should consist of 12 magnetic poles in which N poles and S poles are located alternately at regular intervals. But at the position where the developing sleeve 3703 comes into contact with the scraper 3710, one pole is omitted in order to form a repulsive magnetic field to scrape off developer from the developing roller easily. The magnetic roller 3704 is fixed in the developing sleeve 3703. The magnetic force of the magnet should be stronger in order to prevent carrier from adhering to the photoreceptor. But there is a limitation to the manufacture of the magnetic roller, being restricted by its shape. Therefore, the maximum magnetic flux density in the direction of the normal line on the circumferential surface of the developing sleeve is maintained to be 500 to 700 gauss, in this example 600 gauss. The magnetic roller 3704 is made from ferrite.

The developing sleeve 3703 and the cylindrical rod 3705 are located in the apparatus as shown in FIG. 5. The cylindrical rod 3705 is pressed by the developing sleeve 3703 at the position where the cylindrical rod faces the magnetic pole of the magnetic roller 3704, and is attracted by the induced magnetic force. The pressing force added to the cylindrical rod is increased in this way so that the cylindrical rod can uniformly come into contact with the developing sleeve with pressure.

In the above-mentioned example, the rigid magnetic cylindrical rod 3705 was used as the developer layer thickness control member. The results were so good that reliable and excellent images were obtained without white stripes caused by coherence of developer, toner sticking to the toner layer thickness control member, and degradation of image quality. The magnetic cylindrical rod is superior to the non-magnetic cylindrical rod in the effect mentioned above. The above-mentioned magnetic cylindrical rod can be either the one attracted to the developing sleeve being induced or the one made of a permanent magnet attracted to the developing sleeve.

The important factors to consider to determine the developer conveyance volume, when the developer volume control member having rigidity and magnetism is used which comes into contact with the developing sleeve with pressure, are the radius and the pressing force of the control member.

The bias given to the developing sleeve 3703 is −500V DC bias superimposed by 700 rmsV 4 KHz AC bias.

When the above-mentioned conditions are satisfied in the developing region, toner is effectively supplied from a thin layer of developer on the developing sleeve 3703 to the latent image surface on the photoreceptor 30. Since the above-mentioned developer layer is very thin (10 μm to 450 μm), the gap between the photoreceptor 30 and the developing sleeve 3703, called the development gap, can be reduced, for instance, to 500 μm as mentioned above. Even if the development gap is so small, non-contact development can be completely conducted. When the development gap is reduced like this, the electric field of the developing region is strengthened. As a result, even if bias given to the developing sleeve is low, development is completely carried out, and furthermore it has the advantage of decreasing the leak of bias. Furthermore, resolving power and quality of images are enhanced as a whole.

The tolerance of the development gap is 500±300 μm in this case. Preferably it is 500±150 μm. The tolerance of the development gap is desirably more narrow. The reason is that when this apparatus is practically used, there are many limitations. For instance, in the color copier of this example, the most preferable development gap is 500±50 μm and the gap must be maintained. Units are integrated into one body in the copier of the present invention. The structure characterized by one body is very beneficial in view of maintaining the development gap.

The above-mentioned developing method in which a very thin developer layer on the developing sleeve is used, has a remarkable effect on a developing apparatus with a small size developing sleeve. An explanation will be added as follows. When non-contact development was conducted by a small size developing sleeve whose diameter was not more than about 30 mm, it was difficult to control the thickness of the developer layer. So, a development gap of about 1 mm was needed. For that reason, high voltage AC current bias was needed and resolving power of images, reproducibility of gradation and image quality were degraded as a whole. Furthermore this type of conventional apparatus had a harmful effect as explained below. Minute portions on a document such as letters could not be reproduced, and special attention had to be given to the material and size of the apparatus in order to electrically insulate the developing apparatus.

On the other hand according to the above-mentioned developing apparatus of the present invention, development is conducted by forming a very thin developer layer on the developing sleeve. Therefore, the development gap can be reduced and the electric field can be strengthened. As a result, resolving power of obtained images, reproducibility of gradation, and image quality are remarkably improved. The developing apparatus of the invention has many advantages which are described as follows. Since a small size developing sleeve can be used in the developing apparatus, it can be made compact. Accordingly, the cost can be reduced even though the developing apparatus previously used to be expensive. Another effect of the developing method mentioned above is to prevent carrier and toner from flying in all directions, even when small size carrier and toner are used. When a developer consisting of small particle size carrier (5 μm to 100 μm) and toner was used for development in a conventional developing apparatus, the carrier and toner flew in all directions. The flying carrier and toner caused many problems such as soiling the inside of the apparatus, disturbing color balance by mixing color toner, wherein a color toner is mixed with a different color toner because of flying, and fog on images. The problems mentioned above can be solved by the developing method of the invention.

Another effect of the invention is as follows. Since developing is conducted by the non-contact developing method, only toner adheres to the latent image surface. Therefore, a fog of toner on the latent image surface and adhering of carrier to the latent image surface can be prevented, which tends to occur especially when reversal development is conducted by a photoreceptor with an organic photosensitive layer. In this type of apparatus, the developing sleeve does not come into contact with the photoreceptor. In other words, the developing sleeve does not rub the surface of the photoreceptor at all. Accordingly, the surface of the photoreceptor is not damaged and scratches are never formed on the surface. Resolving power and reproducibility of gradation are excellent, and a sufficient amount of toner can adhere to the surface of latent images As developed images can be superimposed on the photoreceptor on which toner images are formed, this apparatus is suitable for multicolor development in the multicolor image forming apparatus of the present invention.

Figure 7:
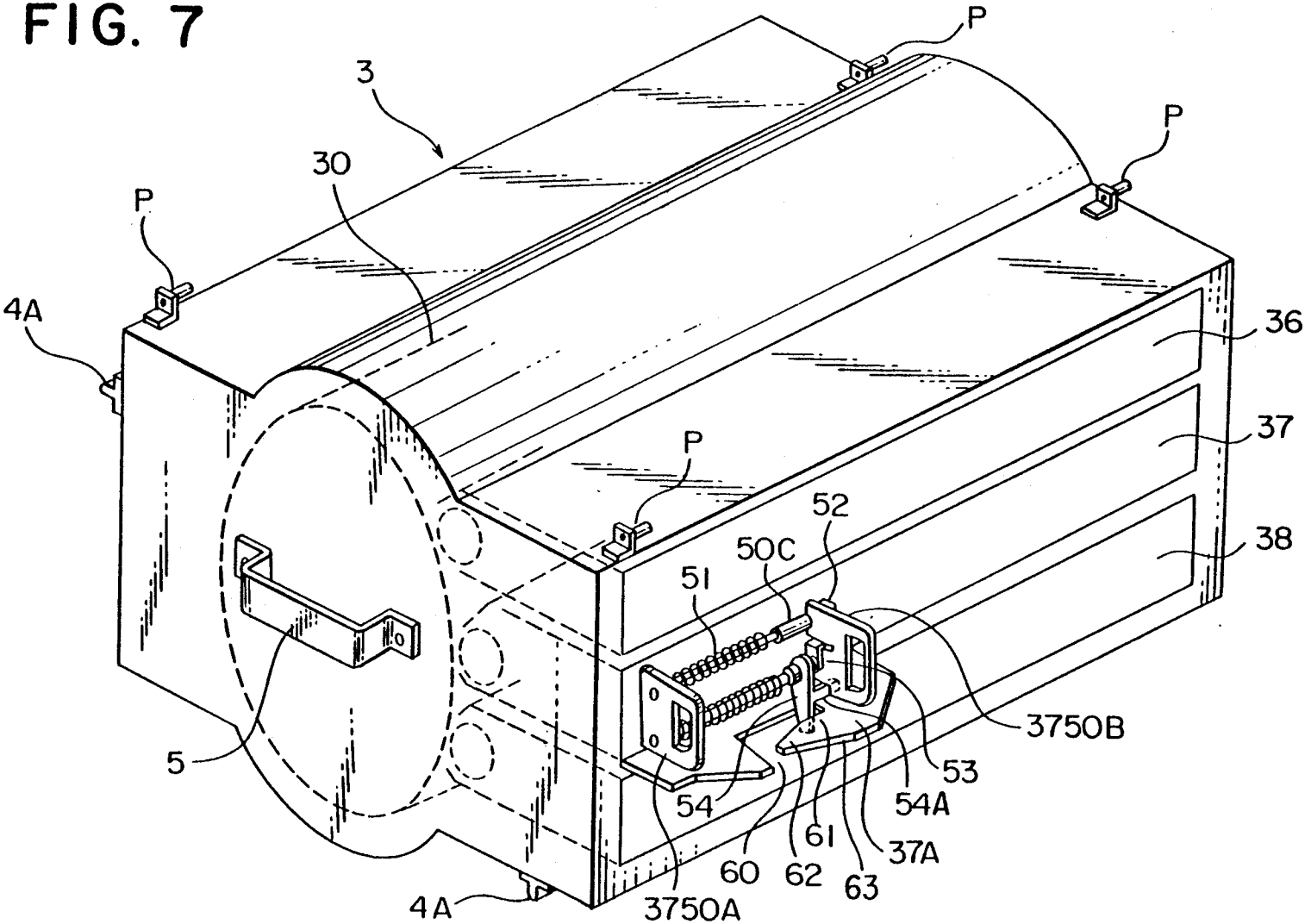
FIG. 7 is a perspective view of the inside of the cartridge.
Figure 8A:
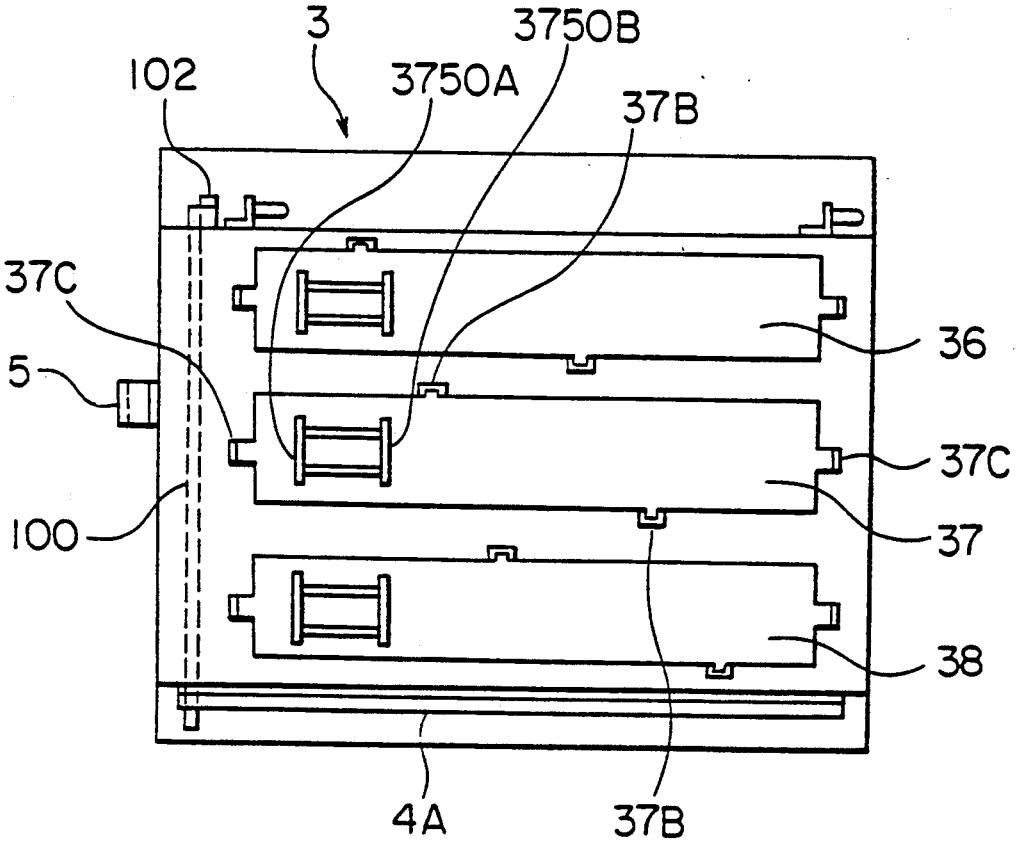
FIGS. 8(*a*), 8(*b*), 8(*c*), and 8(*d*) show the state of the developing unit and the cartridge when the developing unit is mounted on the cartridge in another example.

FIG. 6 is a perspective view of the cartridge 3 which is pulled out from the main body. The photoreceptor 30 and the developing units 36, 37, 38 are built in the cartridge. FIG. 7 is a perspective view which shows the inside of the cartridge 3.

The above-mentioned developing units 36, 37, 38 are simply capable of being mounted on the cartridge 3 and dismounted from the cartridge 3 shown in FIG. 7 by a mechanism described below.

An explanation of the developing unit 37 will be made as follows. At the rear of the developing unit 37, a pair of guide pins 51 are mounted between the fixed handle 3750A and the holding plate 52, wherein a compressed coil spring is set around the pin 51 and the coil spring is pushing the movable handle 3750B which is slidably fitted to the guide pin 51 in the right direction. The movable handle 3750B is fitted to the guide pin 51 and held by it through a pair of bosses 50C which are installed at the upper and lower position The lever 54, which is pushed counterclockwise by the twisted spring 53, is mounted on the lower boss 50C.

The guide plate 37A is fixed to the cartridge 3 and the notch 60 is installed at the edge of the guide plate 37A corresponding to the lever 54.

When the developing unit 37 is mounted on the cartridge 3, the lever 54 comes into contact with the straight portion 61 of the notch 60 and is slightly pushed clockwise by means of spring action exerted by the twisted spring 53. In this way, the developing unit 37 is pushed towards the photoreceptor by means of reaction caused by the twisted spring 53, and the gap (D sd) between the surface of the photoreceptor and the developing sleeve is maintained to be a prescribed value.

When the developing unit 37 is dismounted from the cartridge 3, the movable handle 3750B is slid by hand in the left direction towards the fixed handle 3750A against the spring force. Then the lever 54 reaches the slope portion 62 and starts to rotate counterclockwise. During the rotating motion, the protrusion 54A comes into contact with the movable handle 3750B and the lever stops.

Accordingly, when the handles 3750A and 3750B are pulled simultaneously in the left direction when the boss 50C is at the position where the compressed spring is fully compressed, the lever 54 is released from the notch 60 through the opening portion and the developing unit 37 can be removed from the cartridge 3.

When the developing unit 37 is mounted on the cartridge 3, the front end of the developing unit 37 is set on the guide plate 37A and is pushed into the cartridge by the fixed handle 3750A. Then the lever 54, which is mounted on the movable handle 3750B and located at the right end position of the guide pin 51 by the action of the compressed spring, comes into contact with the front side slope portion 63 and slides on the guide pin 51 together with the movable handle 50B in the left direction being guided by the slope portion 63.

When the lever 54 reaches the opening portion of the notch 60 and the developing unit is further pushed into the cartridge 3, the movable handle 3750B slides in the right direction by the action of the compressed spring, and the lever 54 comes into sliding contact with the slope portion 62 of the guide plate 37A and slightly rotates clockwise, then it reaches the straight portion 61. In this way, the developing unit 37 is set in the cartridge being slightly pushed towards the photoreceptor. The developing units 36, 38 are mounted on the cartridge and dismounted from the cartridge by the same mechanism as the developing unit 37. As explained above, the handles 3750A, 3750B are equipped with the release and lock mechanism used when the developing unit is pushed in and pulled out, and they can also be used as the handles to hold the compact and light developing apparatus. The positions where the handles are installed are not limited to those shown in the example. They should be determined by the state in which the cartridge is pulled out or the weight balance of the developing unit. The handles may be installed at the center or on the right and the left.

In case an operator makes a mistake when the developing units 36, 37, 38 are inserted in the cartridge, a foolproof mechanism has been applied to the apparatus. To be more specific, the following factors have been taken into consideration to make the foolproof mechanism: the length, the depth, and the width of the developing units and the combination of the groove, the hole, the notch, and the like with the protrusion. Furthermore, the number of mechanical components composing the developing units has been taken into consideration.

FIGS. 8(*a*), 8(*b*), 8(*c*), and 8(*d*) show the developing units 36, 37, 38 mounted on the cartridge 3 in another example. FIG. 8(*a*) is a side view of the cartridge which shows the developing unit side of the cartridge. FIGS. 8(*a*), 8(*b*), 8(*c*), and 8(*d*) are schematic illustrations which show the engagement of the developing unit with the cartridge.

FIG. 8(*a*) shows the right side of the cartridge 3 with the developing units 36, 37, and 38 installed.

One of the examples of the foolproof mechanism will be explained as follows. As shown in the example of the developing unit 37, a pair of protrusions 37B are formed on the upper and lower surface. The positions of the protrusions are different from those of other developing units so as to set the developing unit at the right position without fail.

When each developing unit is mounted on the cartridge, as shown in the example of the developing unit 37, the guide rails 37C which are installed on the right and left side of the developing unit 37 engage with the guide members installed in the cartridge 3. Then the developing unit 37 slides horizontally into the cartridge 3 being guided by the guide members. After being mounted on the cartridge 3, each developing unit is pushed by the lock unit towards the surface of the photoreceptor to form a prescribed development gap (D sd).

FIG. 8(*b*) is a top plan view which shows the function of the lock unit in the case of the developing unit 37. The numeral 371A is a groove formed inside the cartridge 3. The guide rail 37C of the developing unit 37 engages with the guide groove 371A and the developing unit 37 slides into the cartridge in the direction indicated by the arrow.

The numeral 100 is a lifter lever formed by a member with a square section which protrudes through the top of cartridge 3. The numeral 101 is a pin mounted on the lever 100. Three pins are mounted at the position corresponding to each developing unit. FIG. 8(*c*) is the view indicated by the arrow A in FIG. 8(*b*). The numeral 102 is a release lever which engages rotatably with the lifter lever 100 on the upper portion of the cartridge 3. The release lever 102 is always pressed to the upper surface of the cartridge 3 as the lifter lever 100 is pulled downward by the stretched spring 103.

The numeral 110 is a stop claw which is mounted inside the cartridge 3 through the support member 111 formed from a resilient plate. The numeral 110A is a guide portion which protrudes from the stop claw 110 and engages with the guide groove 371B formed inside the cartridge 3. Accordingly, the stop claw 110 can change its position horizontally by the deflection of the support member 111.

FIG. 8(*d*) is the view indicated by the arrow B in FIG. 8(*c*). As shown in FIG. 8(*d*), the stop claw 110 has an inclined surface cam 110B at a position corresponding to the pin 101. In FIG. 8(*b*), the numeral 112 is a compressed spring whose one end is fixed to the inside of the cartridge 3 and the other end presses the stop claw 110 in the left direction.

The stop claw 110, the compressed spring 112, and the like are installed for the developing unit 37 as mentioned above, and they are also installed for the developing units 36 and 38 at the proper positions in the cartridge.

FIG. 8(*b*) shows the following state of the developing unit 37. The developing unit 37 is installed at the proper position in the cartridge 3. The stop claw 110 engages with the notch 37D of the guide rail 37C. The stop claw 110 is pushed by the compressed spring 112 in the direction indicated by the arrow. As a result, the developing unit 37 is pushed in the direction of the arrow.

Therefore, a pair of bumping rollers R mounted on both ends of the shaft of the developing sleeve 3703 come into contact with the edge portions of the photoreceptor drum 30. As a result, the prescribed development gap (D sd) is set between the developing sleeve 3703 and the photoreceptor 30.

In order to release the lock of the developing unit 37 and remove the developing unit from the cartridge 3, the end 102A of the release lever 102 Should be pushed up. Then the lifter lever 100 is raised and the pin 101 presses the inclined surface cam 110B of the stop claw 110.

Accordingly, the stop claw 110 rotates counterclockwise horizontally being guided by the guide groove 371B of the guide unit 110A and is disengaged from the notch 37D to release the developing unit 37 from the lock and make it free from the force imposed by the spring.

In this example, the explanation was made that all the developing units were released from the lock at the same time. However, it is possible to provide the lifter lever to each developing unit and release each developing unit separately.

As a result, the developing unit 37 can be easily removed from the cartridge 3 by operating the handles 3750A and 3750B.

When the developing unit is mounted on the cartridge again, the developing unit should be slid in the direction indicated by the arrow as shown in FIG. 8(*b*). By sliding the developing unit in the direction indicated by the arrow, the inclined surface 371C located at the tip of the guide rail 37C presses the inclined surface 110B of the stop claw 110 to make it withdraw automatically and make it engage again when the notch 37D reaches the stop claw 110.

When the developing units 36 and 38 are mounted on the cartridge 3 and dismounted from the cartridge, the same operation as for developing unit 37 is conducted.

The multicolor image forming apparatus of the present invention has a development gap maintaining means such as the bumping rollers R and the like by which a proper development gap is formed and maintained between the photoreceptor 30 and the developing sleeve 3703 that is a developer holder in the developing unit.

The developing unit 37 is equipped with a pair of bumping rollers R which are located on both sides of the developing sleeve 3703 and mounted on the shaft of the developing sleeve 3703 as idlers.

The radius of the above-mentioned bumping rollers R is larger than that of the developing sleeve 3703 by the development gap of 0.5 mm. When the developing unit 37 is mounted on the cartridge 3 and pushed by the lever 54 as mentioned before towards the photoreceptor 30, the developing unit comes into contact with the bumping rollers R to set the developing sleeve 3703 at the position where the gap between the developing sleeve 3703 and the circumferential surface of the photoreceptor 30 is maintained to be 0.5 mm.

The bumping rollers come into contact with the photoreceptor outside the image forming region. Since the bumping rollers are idlers and driven by the photoreceptor 30, the rotation of the photoreceptor is not transmitted to the developing unit 37 and the developing unit 37 is maintained at a constant position.

The developing units 36 and 38 have the bumping rollers to attain the same object as the developing unit 37. When the development gap is determined, the difference of the developing characteristics between the developing units must be taken into account first of all. Then the development gap must be changed a little from that of the developing unit 37 in order to improve color image quality by making various process conditions optimum such as electrification, damping of electric potential of the photoreceptor, developer, development, reelectrification, and the like. Concerning the development gap maintaining means, at least two among a plurality of developing units preferably have different development gaps.

As a plurality of developing units 36, 37, 38 are mounted at the positions close to the circumferential surface of the photoreceptor 30, the distance from the electrifier to each developing unit 36, 37, 38 is different. For that reason, the lapse of time from electrification to development is different.

Electrical potential on the surface of the photoreceptor, made from Se or OPC and charged by the electrifier 35, is reduced with the lapse of time. Therefore, electrical potential of each developing unit 36, 37, 38 at each developing position is different. Electrical potential of the developing unit 36 located at the upper stream is higher than that of the developing unit 37. When the same developing unit and developer are used to copy the same document, the density of the image developed by the developing unit 36 is far higher than that of the image developed by the developing unit 37. The method to solve the problem will be explained as follows. The developing units 36, 37, 38 should be located as closely as possible to decrease the difference of image density. The gap D sd between the photoreceptor and the developing sleeve should be adjusted so that the gap D sd(36) of the developing unit 36 is set to be larger than the gap D sd(37) of the developing unit 37. Almost the same image density can be obtained by this method.

When color development is conducted by the developing unit 36 with magenta toner, the developing unit 37 with cyan toner, and the developing unit 38 with black toner, the image density differs according to the toner. Carbon is contained in black toner and it is not contained in color toner. Therefore, the electrical resistance of color toner is higher than that of black toner. Accordingly, the electric charge of black toner is more than that of color toner. Furthermore, there are differences between colors. Therefore, a disadvantage is that in the case where the gap D sd between the photoreceptor and the developing sleeve of the developing unit is equal in each developing unit, image density and gradation are different between monochrome development and color development. In order to solve the problem, the method to change exposure, electric charge of the photoreceptor, or bias according to the case of black and white development or the case of color development, is disclosed in Japanese Patent Publication Open to Public Inspection Nos. 278877/1986, 238863/1985, 238862/1985, and 238864/1985. Furthermore, the method to change the speed of rotation of the developing sleeve in the developing unit is disclosed in Japanese Patent Publication Open to Public Inspection Nos. 162070/1986, and 969/1987.

Each developing unit is inserted into and held by the color process cartridge, being guided by at least two parallel guides positioned at right angles to the photoreceptor shaft mounted on the color process cartridge main frame.

When the base on the frame to mount the photoreceptor and each guide are made from resin by molding with the same mold, accuracy of size of the each part is guaranteed, and the photoreceptor and each developing unit are set accurately. Especially, the gap between the photoreceptor and the developing sleeve is set accurately.

Furthermore, the base of the electrifier is mounted on the same frame, and the position to electrify and expose the photoreceptor is set accurately and each developing unit is mounted at the proper position according to the base of the reading system by laser beams, the above-mentioned pin and the mount. By integrating each unit into one body in the way mentioned above, each unit is mounted accurately, and variation of the electric potential at the position of each developing unit during color development is positively reduced. When toner superimposing development is conducted, the developed toner image is electrified again and the next development is conducted on the image by reverse development. Especially in the case mentioned above, stability of development is remarkably improved in view of the fact that electric potential on the photoreceptor becomes stable and fluctuation of the electric potential can be reduced.

According to the present invention, the cartridge and the developing units installed in the cartridge can be mounted and dismounted by a very simple operation. As a result, the working efficiency of maintenance, cleaning, replacing units, and the like is high. Along with the above-mentioned, the developing unit can be consistently mounted by a single operation to the proper position where the gap between the photoreceptor and the developing unit can be maintained accurately, and the mounted developing unit is stable against shock and vibration in the apparatus and effective in preventing a color mixture. Accordingly, a very useful multicolor image forming apparatus can be provided which can conduct ordinary multicolor image forming and furthermore conduct very highly accurate adjustment in full color image forming.

As mentioned above, in the case of the cartridge as the multicolor process unit 3A, the developing units can be easily mounted to the prescribed position in the cartridge and dismounted from it. Therefore, an adequate balance of the useful life between the developing unit and the photoreceptor 30, the cleaning unit 39, and the like, can be maintained. Each developing unit which has a comparatively low frequency of use, and therefore has a long useful life, can be continuously used in another multicolor process unit after having been used in a unit. In this way, its longevity is fully utilized.

When the above-mentioned multicolor process unit 3A is set in the main body 2, it is locked by a member which is not shown in the drawing and each unit mounted on the process unit 3A is set to the prescribed position accurately. At the same moment, the process unit 3A is connected with the drive unit and the power unit of the main body 2.

In this example, the developing units 36, 37, 38 are mounted on the multicolor process unit and dismounted from it one by one. Each developing unit may be installed in a developing garage and mounted and dismounted en bloc. Otherwise, each developing unit may be connected with each other to integrate them into one body and mounted and dismounted en bloc.

EXAMPLE TO ATTAIN THE SECOND OBJECT OF THE INVENTION

In order to attain the second object of the present invention, an example will be explained as follows. In the case monochrome images are copied by the above-mentioned color image forming apparatus, a monochrome process unit 3B shown in FIG. 9(*b*) is used. The process of the apparatus is changed to the monochrome copy mode by mounting the monochrome process unit 3B on the apparatus. The monochrome process unit 3B is equipped with the photoreceptor drum 130, the electrifier 135, and the cleaning unit 139 in the same manner as the multicolor process unit 3A. The blade 139A of the cleaning unit 139 always comes into contact with the circumferential surface of the photoreceptor drum 130.

The developing unit used in the above-mentioned monochrome process unit 3B is one developing unit 150 which has a toner box 150B with the function of supplying toner in accordance with the density variation of developed images. The developing unit 150 is installed in the cartridge being closed up tightly. The developing unit is set in the same position as that of the multicolor process unit so that the same drive unit for the developing unit can be used. The multicolor process unit may be composed of four developing units which consist of developing units with yellow, magenta, and cyan toner to which a developing unit with black toner is attached.

Consequently, the monochrome process unit 3B can continuously process a lot of monochrome images. When the image color is changed, the process unit as a whole, is changed. Therefore, developer cannot flow out from the unit.

When the monochrome process unit 3B is used, the copy mode is changed, and the filter corresponding to the objective color is selected. For instance, when black images are processed, the filter ND is set on the optical path of the image reading system A.

In this example, the present invention is explained in the case where the color image forming apparatus uses the toner superimposing development system. The present invention can also be applied to a color image forming apparatus in which a transfer drum is used and images are directly superimposed on a recording paper.

According to the present invention, the color image forming apparatus which was explained in the above-mentioned example, can be provided. The characteristics of the apparatus are as follows. Each unit for color and monochrome image forming is composed of an interchangeable process unit. Therefore, the color image or monochrome image is optionally selected by a very simple operation and various images can be obtained. Furthermore, the process unit can be composed of suitable units selected after careful consideration is given to the useful life of each unit in order to obtain an economical and durable color image forming apparatus.

Example 1 to attain the third object of the invention

An example to attain the third object of the present invention will be described as follows. The color image forming apparatus of the present invention is composed of a cartridge in which a photoreceptor drum, a group of color developing units, a cleaning unit if necessary, an electrifier, a neutralizing unit, and the like are integrated into one body. The cartridge is capable of being set in the apparatus and removed from it quickly, and the group of developing units are replaced according to the toner consumption so that copying can be continued. The developer used in the present invention may be either a one component developer whose main component is magnetic toner or a two component developer whose main components are non-magnetic toner and magnetic carrier. However, in order to obtain the clear image color of the coloring agent contained in the toner, it is preferable to use the above-mentioned two component developer. The toner chamber to supply toner is installed in each developing unit of the group of developing units. Accordingly, toner is supplied in the developing unit and development is continued. However, since the amount of toner contained in the developing chamber is limited, toner is consumed in development and finally development is interrupted.

The developer capacity of the group of the developing units in the color cartridge, is small because the space is limited. For example, developer of 300 to 500 g is contained in the developer chamber and 50 to 100 g of toner is contained in the toner chamber. Therefore, when ordinary copying is conducted on 1000 to 3000 sheets of A4 size recording paper, the toner in the toner chamber is consumed. Furthermore, the amount of toner consumed depends on the developing unit. For instance, when the toner of yellow (Y), magenta (M), and cyan (C) is used, the amount of consumed toner depends on the kind of document. Generally speaking, the amount of comsumption of M toner and C toner is comparatively large and that of Y toner is small.

In order to replace the developing unit, each developing unit may be replaced after the cartridge has been pulled out of the apparatus, or, in the case where the developing units are integrated into one unit, each developing unit may be replaced after the unit is pulled out of the cartridge, or each developing unit in the cartridge mounted on the apparatus may be replaced as it is.

The color image forming apparatus of the present invention may be either the analog type or digital type. The apparatus may be either the each time transfer type in which a transfer drum is used and a toner image is transferred to a transfer paper each time an image is formed on the transfer drum or the one time transfer type in which the transfer drum is not used and each color toner image is superimposed on the photoreceptor, and transferred at one time.

Figure 10:
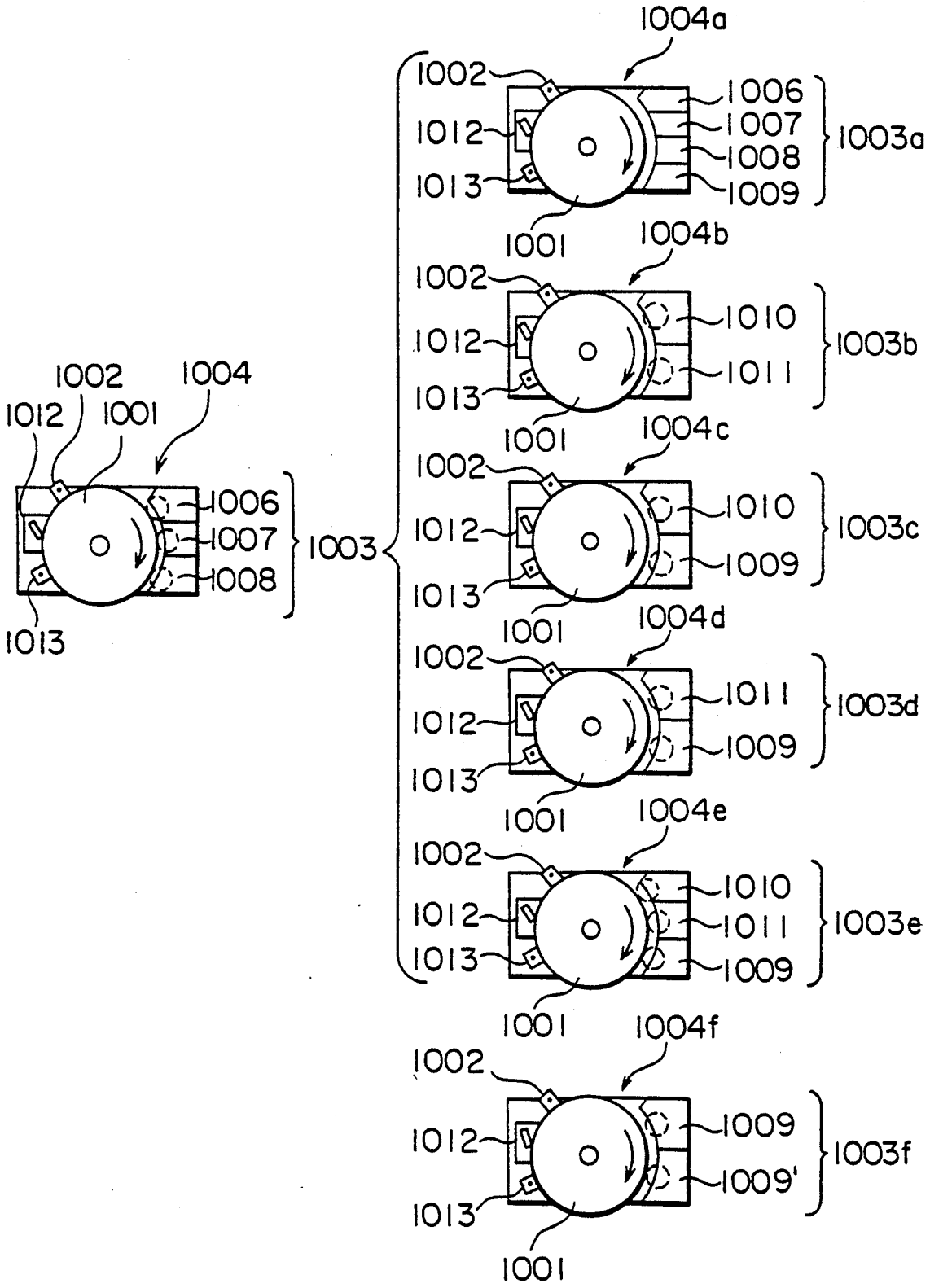
FIG. 10 is a schematic illustration which shows various kinds of cartridges.
Figure 8B:
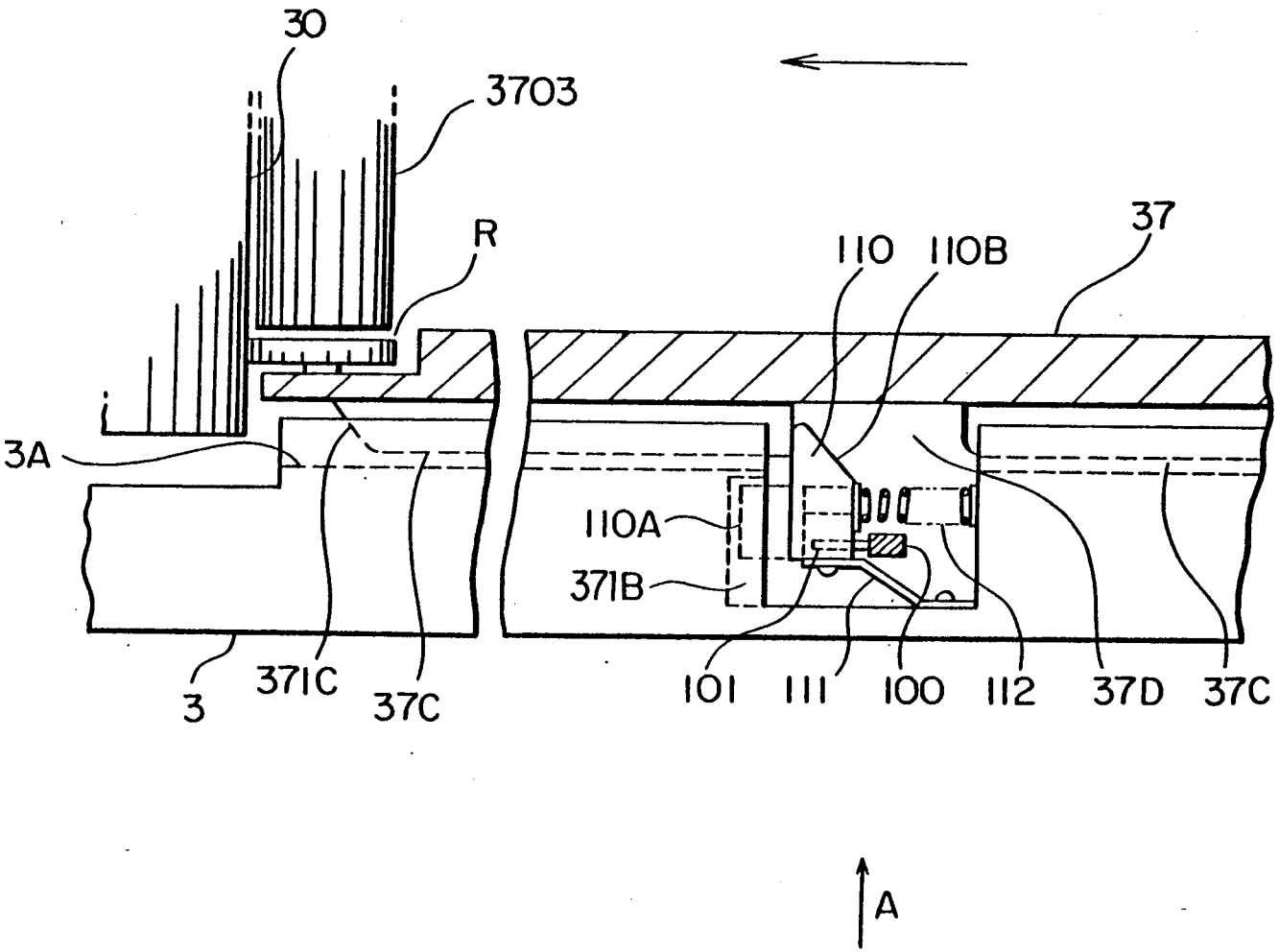
Figure 8C:
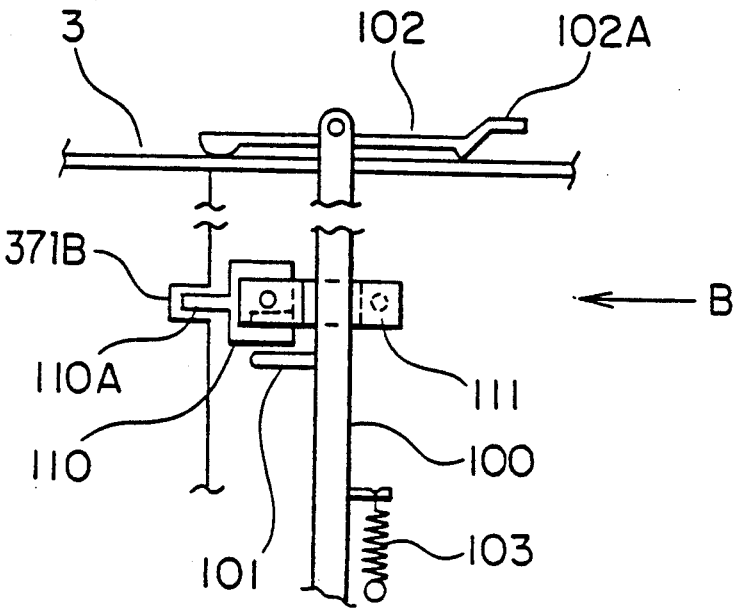
Figure 8D:
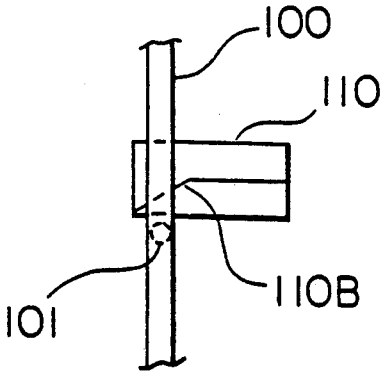

As shown in FIG. 10, the process cartridge to be used in the color image forming apparatus of the present invention may be either the full color cartridge 1004 for Y, M, and C, the full color cartridge 1004*a* for four colors of Y, M, C, and black (BK), the two functional color cartridge 1004*b* for red (R) and blue (B), the two functional color cartridge 1004*c* for R and BK, the two functional color cartridge 1004*d* for B and BK, or the three functional color cartridge 1004*e* for R, B, and BK. The cartridge 1004*f* which has only the black developing unit may be installed as a spare cartridge for the above-mentioned full color cartridge 1004. In FIG. 10, the numeral 1001 is a photoreceptor which rotates in the direction indicated by the arrow. The numeral 1002 is an electrifier. The numerals 1003, 1003*a*, 1003*b*, 1003*c*, 1003*d*, and 1003*f* are developing units. The numeral 1006 is a developing unit for Y. The numeral 1007 is a developing unit for M. The numeral 1008 is a developing unit for C. The numerals 1009 and 1009' are developing units for BK. The numeral 1010 is a developing unit for B. The numeral 1012 is a cleaning unit. The numeral 1013 is a neutralizer.

The image forming apparatus of the present invention may have a clamshell type structure. In the case of the clamshell type structure, the advantage is that replacing a process cartridge can be conducted easily, repair work can be easily carried out when a paper jam occurs, and parts can be easily replaced. In the case of the clamshell type structure, a gap in the unit to replace parts is not needed. Accordingly, the apparatus becomes compact.

The following examples describe several preferred embodiments to illustrate the invention. However, it is to be understood that the invention is not intended to be limited to the specific embodiments.

The first example, in order to attain the above-mentioned third object, has a counter to indicate the number of copied papers and has a structure in which a developing unit combined with a toner chamber can be mounted and dismounted quickly.

Figure 11:
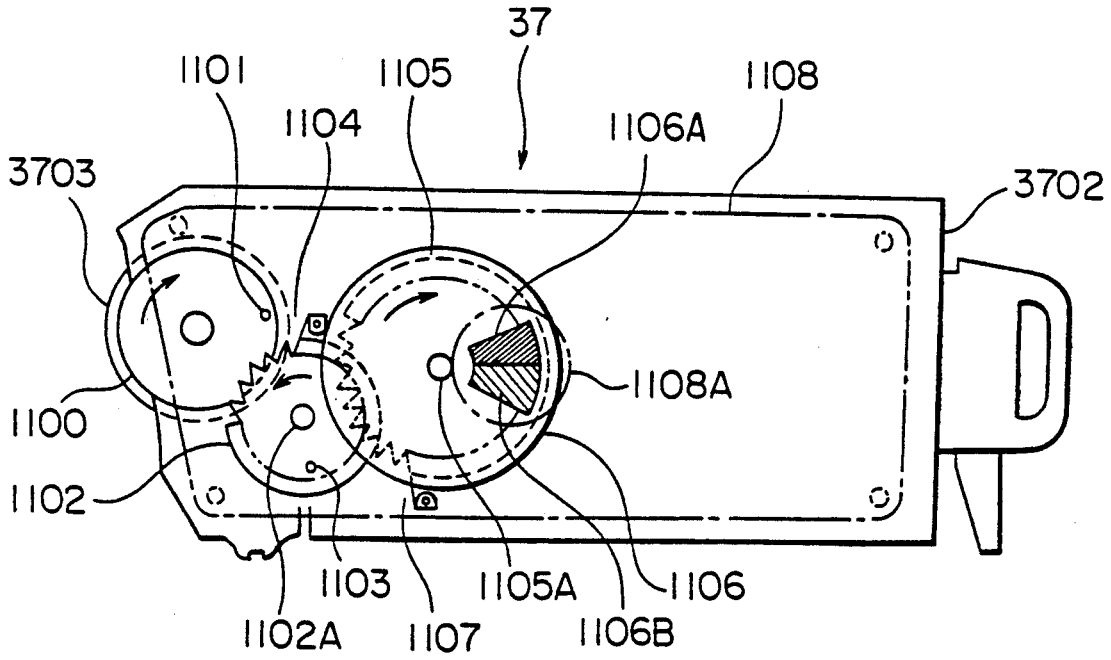
FIG. 11 and FIG. 12 are a side view and a perspective view of a counter mechanism which is installed in the above-mentioned developing unit.

The structure of the developing unit of this example will be described as follows. A counter shown in the developing unit 37 in FIG. 11 is installed on the side of the housing 3702 which is located in the front side of the main body 2 of the color image forming apparatus shown in FIG. 1. This counter counts the number of rotations of the developing sleeve 3703 and the amount of the remaining toner can be known according to the indication of the counter.

The numeral 1100 is a disk which is located on the outside of the housing 3702 and mounted on the shaft of the developing sleeve 3703. The numeral 1101 is a pin to drive the disk 1100 which is mounted on the circumferential portion of the disk 1100. The numeral 1102 is a ratchet wheel which rotates around the shaft 1102A located on the outside. The ratchet wheel 1102 is equipped with ratchets which engage with the above-mentioned pin 1101 and with a pin 1103.

The numeral 1105 is a ratchet wheel which rotates around the shaft 1105A on the outside and it has ratchets which engage with the above-mentioned pin 1103. The ratchet wheel 1105 and the disk 1106 are mounted and fixed on the same shaft and rotate around the shaft.

On the above-mentioned disk 1106, there are semicircular warning marks. For instance, a yellow mark 1106A and a red mark 1106B are on a white background, and they are adjacent to each other. These warning marks are indicated according to the rotation of the disk 1106 which rotates in the direction indicated by the arrow, in the opening 1108A on the counterbar board 1108 which is mounted on the outside of the developing unit 37.

When the developing unit 37 has not been used, the disk 1106 which is mounted on the same shaft as the ratchet wheel 1105, is at a more clockwise advanced position than the position shown in FIG. 11. Therefore, the yellow mark 1106A and the red mark 1106B are covered by the board and the white background appears in the opening 1108A. The white background in the opening 1108A indicates that the amount of the toner in the developing unit is more than the prescribed volume.

When the developing unit 37 comes into operation in order to develop the latent image on the photoreceptor 30, the counter mechanism works as follows. When the developing sleeve starts rotating clockwise and makes one revolution, the pin 1101 on the disk 1100 rotates the ratchet wheel 1102 counterclockwise by an angle corresponding to one ratchet. Furthermore, when the ratchet wheel 1102 makes one revolution counterclockwise, the pin 1103 mounted on the ratchet wheel 1102 rotates the ratchet wheel 1105 clockwise by an angle corresponding to one ratchet. As a result, the disk 1106 is rotated at a very slow speed since it is slowed down.

Therefore, in the case where the numbers of the ratchets of the ratchet wheels 1102 and 1106 are set so that the disk 1106 can make one revolution just when almost all the toner in the developing unit 37 is to consumed, as determined by the rotation of the developing sleeve 3703, the marks 1106A and 1106B can be used as warning marks to indicate the remaining toner in the developing unit.

As shown in FIG. 11, the warning marks 1106A and 1106B can be easily checked through a window in the cartridge 3, wherein the position of the window coincides with that of the opening 1108A.

When the white ground of the disk 1106 is indicated in the window, the amount of the toner in the developing unit is more than the prescribed volume. When the mark 1106A appears in the window, the amount of the toner is approaching the lower limit. Furthermore, when the mark 1106B is indicated in the window 3, it warns that the toner in the developing unit is almost, or completely, consumed. In such a case, toner must be supplied to the developing unit or the developing unit must be replaced in the case of the disposable developing unit.

The ratchet wheels 1102 and 1106 are maintained in the proper rotative positions, each time they are rotated by a ratchet, by the lock action of the sprung stopping plates 1104 and 1107.

Figure 12:
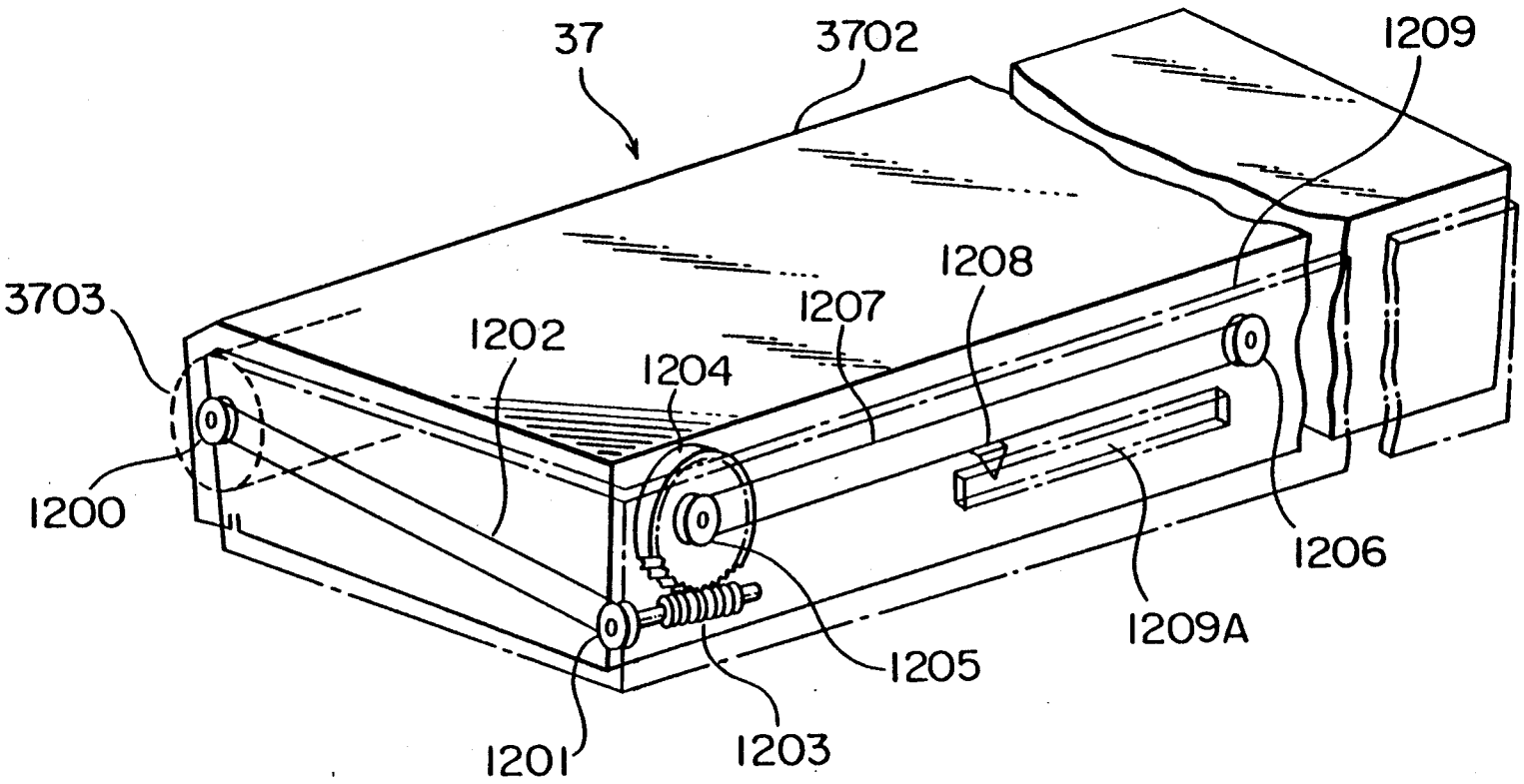

FIG. 12 shows another example of the counter. In this example, the amount of the toner in the developing unit is indicated on the rear side of the developing unit.

In FIG. 12, the numeral 1200 is a pulley which is located on the outside of the housing 3702 of the developing unit 37 and mounted on the shaft of the developing sleeve 3703. The pulley can rotate together with the developing sleeve. The numeral 1201 is a pulley which is held at the edge of the rear side of the housing 3702 by a bearing. This pulley 1201 is driven by the pulley 1200 through the belt 1202. The numeral 1203 is a worm Which is mounted on the same shaft as the pulley 1201. The numeral 1204 is a worm gear which engages with the worm 1203. The numeral 1205 is a pulley which is mounted on the same shaft as the worm gear 1204. The numeral 1206 is a pulley which is mounted on the shaft located on the rear side of the developing unit. The belt 1207 to which the indicator 1208 is fixed, is stretched between the pullies 1205 and 1206.

In this example, the rotation of the developing sleeve 3703 is transmitted to the pulley 1201 on the rear side through the belt 1202, and transmitted to the pulley 1205 after being greatly slowed down by the worm 1203 and the worm gear 1204.

The amount of the remaining toner in the developing unit can be indicated by the above-mentioned device as follows. The indicator 1208 indicates the amount of the remaining toner in the range of the index F (FULL) and the index E (EMPTY) according to the number of rotations of the developing sleeve 3703 corresponding to the amount of the consumed toner. The indexes F and E are shown from the opening 1209A installed in the cover board 1209.

In this example, the mechanisms to mount the developing unit 37 on the cartridge 3 and to dismount the developing unit 37 from the cartridge 3, such as the handles 3750A and 3750B and the like, are installed outside the counter cover board 1209.

The present invention enables a very simple indicating device to indicate very positively the amount of the remaining toner in the developing unit both when the developing unit is being used and when the developing unit is not being used. As a result, the color image forming apparatus can be provided which can copy high quality color images with proper density due to well controlled toner supply.

Example 2 to attain the third object will be explained as follows.

In this example, the toner in the toner chamber is detected by an optical detecting device, a magnetic detecting device, a detecting device (LTD) in which the wave form of vibration of an electrostriction member or a piezoelectric member is utilized, and the like. The developing unit is replaced according to the signal obtained from the detector.

Figure 13:
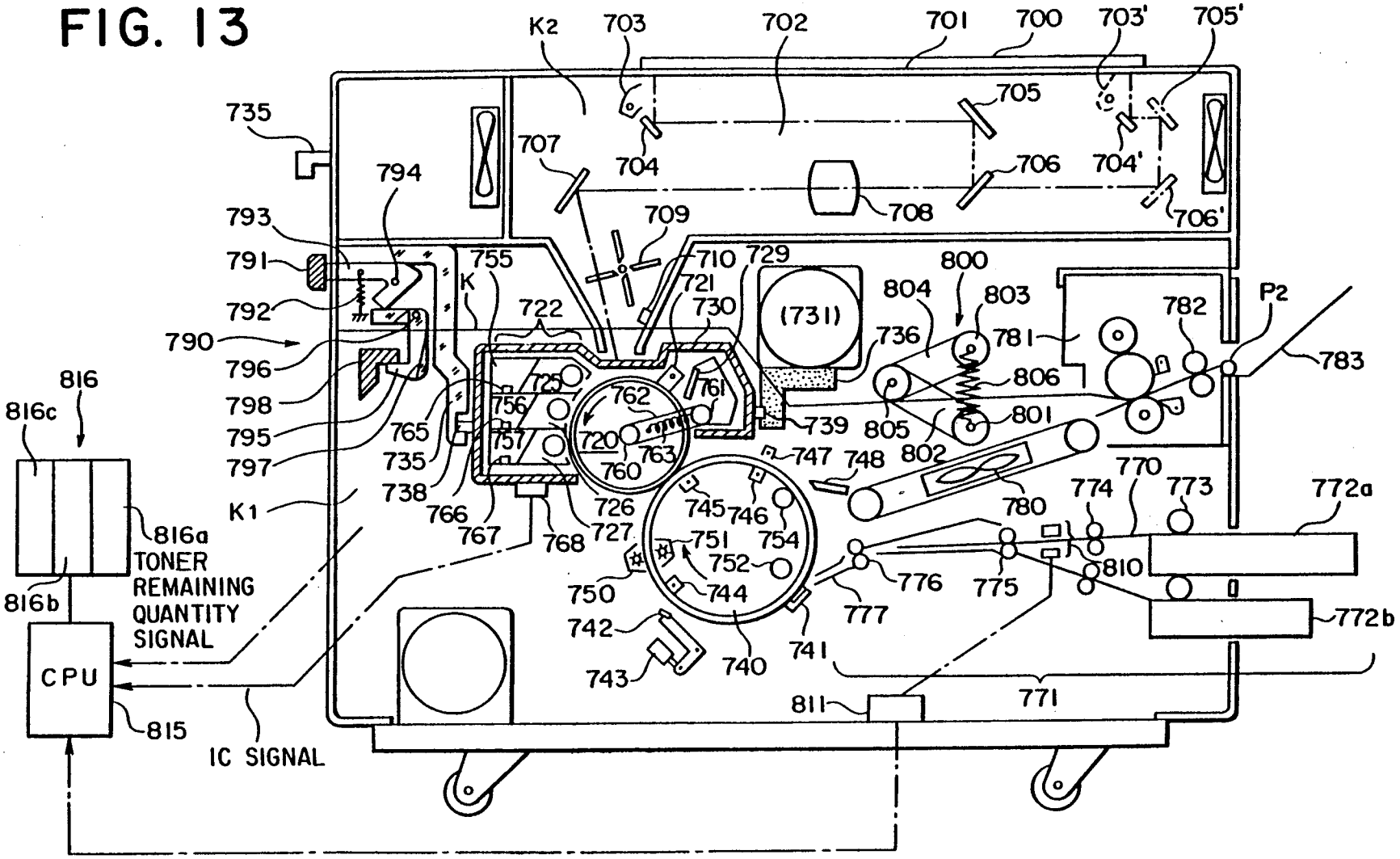
FIG. 13 and FIG. 14 are sectional views of the color image forming apparatus to explain the examples of the invention.

FIG. 13 is a schematic illustration to explain the example. In the drawing, the numeral 700 is a color document. The numeral 701 is a document platen. The numeral 702 is an optical system to expose the document image. The optical system is composed of the light source 703, the reflection mirrors 704 to 707, the lens 708, the group of blue, green, and red filters 709, and the filter detecting device 710.

The light source 703' and the reflection mirrors 704' to 706' indicate the positions of the optical system light source 703 and the reflection mirrors 704–706 after they are moved. In this case, the process cartridge 730 in which the photoreceptor drum 720, the electrifier 721, yellow developing unit 725, magenta developing unit 726, cyan developing unit 727, the neutralizer before cleaning 728, and the cleaning unit 729 are installed, is mounted in the apparatus. The above-mentioned process cartridge 730 is slidably suspended by the guide rails 738 and 739 of the suspension units 735 and 736 which are fixed to the upper box unit $K_2$. The numeral 740 is a transfer drum. The numeral 741 is a gripper to fix the tip of a transfer paper to the transfer drum 740. The numeral 742 is a pusher to press a transfer paper to the transfer drum by the action of the solenoid 743 in order to wind the transfer paper around the transfer drum in cooperation with the action of an adsorption electrifier 744. The numeral 745 is a transfer unit. The numerals 746 and 747 are neutralizers. The numeral 748 is a claw to separate the transfer paper.

The numerals 750 and 751 are cleaning units to clean the surface of the transfer drum after the transfer paper is separated from the drum. The numeral 752 is a cam to turn on and off the gripper 741. The numeral 754 is a cam to turn on and off the separation claw 748.

The numeral 760 is a hollow shaft of the photoreceptor drum 720 which rotates in the direction indicated by the arrow. The numeral 761 is a toner container for the cleaning unit 729. The toner container 761 is connected with the pipe 762 in which a coil spring 763 to convey the used toner is provided. The used toner scraped off by the cleaning unit 729 is continuously collected in the photoreceptor drum 720 and removed to the outside of the apparatus when the process cartridge is replaced.

Yellow developing unit 725 has yellow toner chamber 755, magenta developing unit 726 has magenta toner chamber 756, and cyan developing unit 727 has cyan toner chamber 757. Each toner chamber contains 70 g of toner for supply. These developing units with toner chambers are integrated into one unit and they can be mounted on the cartridge and dismounted from the cartridge as one unit. The remaining toner detecting units 765, 766, and 767 are installed in the above-mentioned toner chambers 755, 756, and 757. The remaining toner in each toner chamber is detected by the remaining toner detecting units 765, 766, and 767. In the experiment, at the 2000th copy paper, LED display unit 816*b* in LED display unit 816 was lit by a signal from magenta developing unit 726 through CPU 815, then at the 2010th copy paper, LED display unit 816*c* was lit by the signal from the cyan developing unit 727. In this way, warning of toner consumption of both developing units was given. Then, the developing unit 722 was pulled out and magenta developing unit 726 and the cyan developing unit 727 were replaced, and color copying was continued. At the 3000th copy paper, the display unit 816*a* gave warning of toner consumption of the yellow developing unit 725. So, the unit 722 was pulled out and the yellow developing unit 725 was replaced. In order to detect the remaining toner, the detecting device (LTD) which utilizes vibration of the electrostriction member, was used. Details of the detector are disclosed in Japanese Patent Publication Open to Public Inspection No. 36874/1980 which was proposed by the applicants.

As mentioned above, making a copy was continued by replacing the developing unit. There are problems about the useful life of the cartridge caused by fatigue of carrier, the photoreceptor, the cleaning member, and the like.

In this example, an IC memory which stores the maximum number of copy sheets corresponding to the useful life of the cartridge 730, was mounted on the cartridge 730. The signal from the IC memory and the signal from the counter which counts the number of transfer papers using the signal obtained from the transfer paper detector 810, were checked and compared by CPU 815. When the number of transfer papers reached the limit, in this case 50,000 color copies, the cartridge was replaced. The numeral 771 is a means to supply transfer paper 770. A transfer paper 770, which is delivered by the paper feeding roller 773 from the cassette 772*a* in which A4 size transfer papers are set laterally, is conveyed to the transfer drum 740 by the paper feeding guide 777 through the conveying rollers 774, 775 and the timing roller 776. The transfer paper 770 winds around the transfer drum 740 and is fixed to it by the action of the gripper 741, the press unit 742, the adsorption pole 744, and the like. The transfer paper wound on the surface of the transfer drum 740 in this way is conveyed in accordance with the rotation of the transfer drum. Yellow toner images, Magenta toner images, and Cyan toner images are transferred in turn onto the transfer paper by the action of the transfer pole 745 and the rotation of the photoreceptor drum 720 and the transfer drum 740. The transfer paper 770 on which color toner images are transferred, is neutralized by the neutralizers 746, 747 and separated from the transfer drum by the separating claw 748. Then the transfer paper is conveyed to the fixing unit 781 by the conveyance belt 780. After being fixed, the transfer paper 770 is discharged to the tray 783 by the paper discharge roller 782.

The structure of the clamshell will be specifically explained as follows. The numeral 790 is a locking member of the lower box unit $K_1$ and the upper box unit $K_2$. The numeral 800 is an open position restricting member. When the upper box unit $K_2$ is opened by the handle 735 while rotating on the shaft $P_2$, the knob 791 of the locking member 790 mounted on the upper box unit $K_2$ must be pushed upward against the spring 792. The lever 793 is rotated clockwise on the shaft 794 by pushing the knob 791 upward. The upper tip of the lever 795 is pushed downward by the lever 793, and the lever 795 is rotated counterclockwise on the shaft 796 against the spring 797. Finally, the lever 795 is disengaged from the lock unit 798 and the upper box unit $K_2$ can be opened upward. It is opened slowly by the force of the spring 806 of the open position restricting member 800. The structure of the open position restricting member 800 will be described as follows. The lever 802 is rotatably mounted on the shaft 801 installed in the lower box unit $K_1$ and the lever 804 is rotatably mounted on the shaft 803 installed in the upper box unit $K_2$. Another end of the lever 802 is rotatably connected with another end of the lever 804 by the shaft 805 which is not mounted on the box unit S. The spring 806 is installed between the shaft 801 and the shaft 803. The upper box unit is opened and closed slowly owing to the buffer action of the spring 806. When the upper box unit $K_2$ is closed, the levers 802 and 804 are folded. When the upper box unit $K_2$ opens with the help of the force of the spring 806, the lever 802 and the lever 804 are stretched out, and they form a straight line. When the levers are stretched out, the upper box unit $K_2$ forms an angle of 20° with the lower box unit $K_1$. The stretched levers restrict the movement of the upper box unit so that it may not open too widely and they support the weight of the upper box unit at the same time.

When the upper box unit is closed, the lever 802 and the lever 804 of the open position restricting members are folded. The motion of the locking member 790 when the upper box unit is closed, is explained as follows. The lower end of the lever 795 is pushed by the upper surface of the lock unit 798 and the lever 795 rotates counterclockwise to engage automatically with the lock unit 798 by the action of the spring 797. The process cartridge 730 and the transfer drum 740 are automatically positioned by the above-mentioned upper box unit opening and closing motion.

The developer used in this example is as follows.

Carrier: Coated carrier. Ferrite particles whose average diameter was 50 μm were coated with styrene acrylic (1:1) resin at a thickness of 1 μm.

Toner:

- Polyester resin (UXK-120P) (manufactured by Kao Co.): 100 parts by weight
- Quinoline yellow pigment: 10 parts by weight
- Polypropylene (Viscol 660P) (manufactured by Sanyo Chemical Industry Co.): 4 weight parts The above-mentioned components were kneaded, cooled, crushed, and classified to make toner the average particle diameter of which was 11 μm. 7 parts by weight of toner per 100 parts by weight of carrier were mixed to obtain the developer of this example.

50,000 color copies were continuously made with the above-mentioned color image forming apparatus in which the OPC photoreceptor was used, wherein the developing units were replaced during copying. As a result, high quality color images were continuously obtained.

Example 3 to attain the third object of the invention

Figure 14:
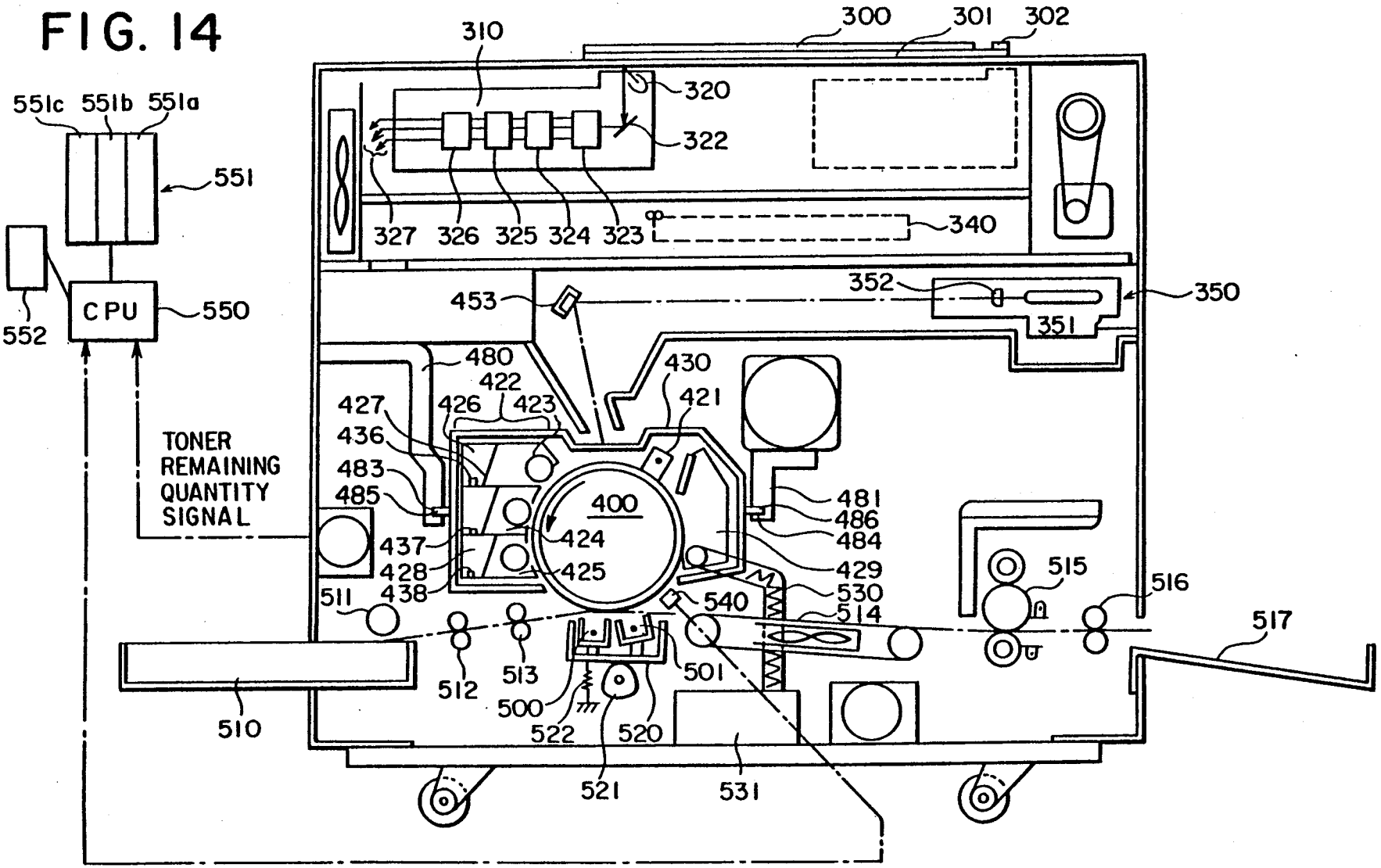

FIG. 14 shows a digital type color image forming apparatus to explain this example The following units are installed in this apparatus. The process cartridge 430 is mounted on the apparatus. It is capable of being mounted on the apparatus and dismounted from the apparatus quickly. In the process cartridge, the following units are installed. The developing unit 422 in which the same red developing unit 423, blue developing unit 424, and black developing unit 425 as the group of the developing units 1003*e* shown in FIG. 10 are installed in the process cartridge, as well as the electrifier 421, and the cleaning unit 429. The toner chambers 426, 427, 428 to supply toner are installed in the above-mentioned developing units. Each toner chamber is equipped with the remaining toner detecting members LTD 436, 437, 438 and the remaining toner in the toner chamber is detected by the above-mentioned detecting member while the copier is in operation. The detected results are transmitted to CPU 550 and LED 551 (551*a*, 551*b*, 551*c*) are lit to give warning of the amount of the remaining toner. According to the warning, the developing unit is replaced.

The cleaning unit 429 is connected with the screw conveyor 530 to collect the used toner into the used toner box 531.

The color document 300 set on the platen glass 301 was read out by the reading system which will be described later. The image was written and formed on the photoreceptor drum 400 by a laser beam modulated by the obtained readout signal. In the reading system, the numeral 310 is a document scan unit. The reflected light of the light source 320 was reflected by the mirror 322 and separated into red (R) and cyan (C) by the color separation prism 323. The separated colors were converted to two systems of electric signals of R and C by the photoelectric transfer unit 324 consisting of two CCD. These signals were amplified by the amplifier 325, converted to digital signals by A/D converter 326, and outputted to the image processing apparatus 340. In the image processing apparatus 340, the above-mentioned two systems of digital signals of R and C were processed in the color separation information generating unit and the signals were separated into three colors, R, B, and black (BK) to obtain the above-mentioned recording signals of three colors. Only the R signal among the three signals was taken out to output to the laser scanner 350. The numeral 351 is a polygonal mirror. The numeral 352 is a $f\theta$ lens.

At the above-mentioned scanner 350, the laser beam was modulated by the R recording signal and the signal was written on the OPC photoreceptor drum 400 which was uniformly electrified by the electrifier 421 beforehand. The latent image was formed in this way.

This latent image was developed with the red developing unit 423 by the non-contact reversal developing method, and a red toner image was formed on the photoreceptor. In the next process, the cleaning unit 429, the transfer unit 500, the separating unit 501, and the like were released. In this released state, the photoreceptor was rotated and exposed by laser beams according to the next B recording signal, and the electrostatic latent image was formed on the photoreceptor. The latent image was developed with the blue developing unit 424 by the same non-contact developing method as the red toner image. The formed blue toner image was superimposed on the above-mentioned red toner image. In the same way, the photoreceptor was exposed to laser beams according to the BK recording signal and the electrostatic latent image was developed with the black developing unit 425. Then the black toner image was superimposed on the above-mentioned red toner image and blue toner image on the photoreceptor. These superimposed toner images were transferred together by the action of the transfer pole 500 onto a transfer paper of A4 size which was conveyed from the cassette 510 in which transfer papers of A4 size were set laterally, by the delivery roller 511, the conveyance roller 512, and the timing roller 513. The transfer paper was separated from the photoreceptor drum by the separating pole 501 and conveyed to the fixing unit 515 by the conveyance belt 514. The transfer paper with color images was fixed by the heated roller 515 and delivered by the delivery rollers 516 to the tray §17. The desired full color image was obtained in this way.

The process cartridge 430 was suspended by the cartridge suspension unit 480 and 4&1, and the protrusions 485 and 486 were engageable with the guide grooves 483 and 484 to be capable of being slidably mounted on the apparatus and dismounted from the apparatus.

The following developer was used in the example.

Carrier: Coated carrier Particles of copper-zinc alloy type ferrite whose average diameter was 40 μm, which were coated with styrene-acrylic (1:1) resin whose thickness was 1 μm Toner:

- Polyester resin (UXK-120P) (Manufactured by Kao Co.): 100 parts by weight
- Polypropylene (Viscol 660P) (Manufactured by Sanyo Chemical Industry Co.): 4 parts by weight
- Red Pigment: 10 parts by weight The above-mentioned materials were mixed by a Henshel Mixer. Then, they were completely kneaded by three rollers at a temperature of 140° C. After that, they were cooled in the air. After being crushed roughly, they were crushed into fine particles and classified to obtain R colored particles the average diameter of which was 11 μm. In order to obtain B and BK color particles, phthalocyan blue and carbon black were used instead of red pigment.

Toner of 7 parts by weight was mixed with the above-mentioned carrier of 100 parts by weight and R developer, B developer, and BK developer were obtained.

The above-mentioned developer was put into the color image forming apparatus shown in FIG. 3. Transfer papers of A4 size were laterally sent into the apparatus to form functional color images. In this example, when 2000 copies were made with the OPC photoreceptor, the signal of toner consumption was outputted from LTD 438 of the black developing unit 425, and the CPU 550 caused the LED 551*c* to produce a signal and warning was given. Therefore, copying was stopped and the group of the developing units 422 was pulled out to replace the developing unit 425. After that, copying was continued. When the 3000th copy was made, the signal was outputted from LTD 436 of the red developing unit 423 and the LED 511*a* was lit. After that, when the 3100th copy was made, the signal was outputted from LTD 437 of the blue developing unit 424 and LED 551*b* was lit to give warning. Accordingly, copying was stopped and the group of developing units 422 was pulled out to replace the developing units 423 and 424. Then, color copies were continuously made while the developing units were replaced if necessary.

The functional color document 300 with R, B, and BK color patches of 2×25 cm size on its tip, was set on the platen glass 301, and copying was conducted. Each color density of the toner image was detected by the sensor 540 (540R, 540B, and 540BK). The obtained signal was compared with the standard value of the standard density memory by CPU 550. When the number of copied papers reached 60000, the density of the obtained image became lower than the standard density. Therefore, the cartridge 430 was replaced.

A lot of color copies were made in this way and high quality copies were stably obtained.

The advantage of this example was that the apparatus could be made compact and light since the transfer drum was eliminated because the superimposed color toner images on the photoreceptor were transferred together onto a transfer paper.

In this example, since the developing unit is replaced in accordance with the toner consumption, both toner and carrier are replaced. As a result, stable color copying can be conducted for a long time. Furthermore, image quality can be easily controlled and an image of high quality can always be obtained because the digital system is adopted in this example. It is a great advantage that the main units for color copying can be integrated into a cartridge at a practical cost and a color copy of high quality is positively guaranteed.

It is obvious from the above-mentioned explanation that the following effect can be obtained from the apparatus of the present invention. According to the color image forming apparatus of the present invention, the process cartridge to form a color image is adopted and a plurality of developing units in the cartridge can be replaced in accordance with the amount of the consumed toner, so a color copy of high quality can be continuously obtained at a practical cost.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A multicolor image forming apparatus comprising:
means for carrying an image;
a plurality of developing devices of differing colors for developing a latent image formed on said image carrying means into a color toner image;
a process cartridge for housing the image carrying means and the plurality of developing devices, the process cartridge adapted to be detachably mountable in said multicolor image forming apparatus,
each of the plurality of developing devices being detachably mountable substantially in the process cartridge and each having means for indicating when its replacement is necessary due to toner consumption.

2. The apparatus of claim 1, wherein said process cartridge includes a means for mounting each of said plurality of developing devices, said mounting means including a means for guiding each of said plurality of developing devices into a predetermined position relative to the image carrying means and a means for coupling each of said developing devices to said process cartridge in the predetermined position.

3. The apparatus of claim 2, wherein each of the plurality of developing devices has a corresponding proper position in the process cartridge, the guiding means only allowing each of the plurality of developing devices to be mounted in the process cartridge in their corresponding proper position and preventing each of the plurality of developing devices from being mounted in the process cartridge in an improper position.

4. The apparatus of claim 1, wherein said indicating means includes a plurality of means for counting the number of times said plurality of developing devices are operated, each of said plurality of counting means being associated with a respective one of said plurality of developing devices.

5. The apparatus of claim 1, wherein said indicating means includes a plurality of means for measuring the quantity of toner remaining in said plurality of developing devices, each of said plurality of measuring means being associated with a respective one of said plurality of developing devices.

6. The apparatus of claim 1, further comprising a second process cartridge for housing a second means for carrying an image and means for developing a latent image formed on said second image carrying means into a monocolor toner image, said second process cartridge being detachably mountable in said multicolor image forming apparatus so as to be capable of replacing said process cartridge.

7. A multicolor image forming apparatus comprising:
a color process cartridge detachably mountable in the multicolor image forming apparatus including,
means for developing an image, said developing means including a plurality of developing devices,
a plurality of supply means for supplying toner to the plurality of developing devices,
each of said plurality of supply means being associated with a respective one of said plurality of developing devices to form a corresponding detachable assembly unit, each assembly unit being capable of being inserted into and removed from the color process cartridge as a unit separately from any other assembly unit.

8. The apparatus of claim 7, wherein said color process cartridge includes a means for mounting each of said plurality of developing devices, said mounting means including a means for guiding each of said plurality of developing devices into a predetermined position and a means for coupling each of said developing devices to said color process cartridge in the predetermined position.

9. The apparatus of claim 8, wherein each of the plurality of developing devices has a corresponding proper position on the color process cartridge, the guiding means only allowing each of the plurality of developing devices to be mounted in the color process cartridge in their corresponding proper position and preventing each of the plurality of developing devices from being mounted in the color process cartridge in an improper position.

10. The apparatus of claim 7, further including a detecting means for indicating when a predetermined quantity of toner has been consumed, said detecting means including a plurality of means for counting the number of times said plurality of developing devices are operated, each of said plurality of counting means being associated with a respective one of said plurality of developing devices.

11. The apparatus of claim 7, further including a detecting means for indicating when a predetermined quantity of toner has been consumed, said detecting means including a plurality of means for measuring the quantity of toner remaining in said plurality of supply means, each of said plurality of measuring means being associated with a respective one of said plurality of supply means.

12. The apparatus of claim 7, further comprising a monocolor process cartridge including a monocolor means for developing an image and a monocolor supply means for supplying toner to said monocolor developing means, said monocolor process cartridge being detachably mountable in said multicolor image forming apparatus so as to be capable of replacing said color process cartridge.

13. A multicolor image forming apparatus comprising;

means for carrying an image;

means for developing a latent image formed on said image carrying means into a toner image, said developing means including a plurality of developing devices;

a cartridge housing which surrounds substantially all of said image carrying means to inhibit toner from escaping from within said cartridge housing, wherein said cartridge housing is detachably mountable in said multicolor image forming apparatus, and said plurality of developing devices are detachably mountable in said cartridge housing.

14. The apparatus of claim 13, further including a plurality of supply means for supplying toner to said plurality of developing devices, said plurality of supply means being detachably mountable in said cartridge housing.

15. An image forming apparatus comprising:

a cartridge housing which is detachably mountable in said image forming apparatus;

means for carrying an image, the image carrying means being mounted in said cartridge housing;

means for developing a latent image formed on said image carrying means into a toner image, said developing means including a developing device, said developing device being detachably mountable substantially within said cartridge housing;

a supply means for supplying toner to said developing device, said supply means being detachably mountable substantially within said cartridge housing.

* * * * *